US005542523A

United States Patent [19]

Abbate et al.

[11] Patent Number: 5,542,523

[45] Date of Patent: Aug. 6, 1996

[54] NEEDLE TRANSPORTING APPARATUS

[75] Inventors: Richard Abbate, Wallingford; Richard Parente, Milford, both of Conn.

[73] Assignee: United States Surgical Corporation, Norwalk, Conn.

[21] Appl. No.: 372,706

[22] Filed: Jan. 13, 1995

Related U.S. Application Data

[60] Continuation of Ser. No. 131,908, Oct. 5, 1993, abandoned, which is a division of Ser. No. 959,151, Oct. 9, 1992, Pat. No. 5,282,715.

[51] Int. Cl.[6] ..... B65G 47/24

[52] U.S. Cl. ..... 198/384; 198/456

[58] Field of Search ..... 198/393, 394, 198/396, 397, 429, 430, 443, 456, 346.2, 428, 347.2, 384

[56] References Cited

U.S. PATENT DOCUMENTS

| | | | |
|---|---|---|---|
| 160,686 | 3/1875 | Kingman . | |
| 279,075 | 6/1883 | Berry . | |
| 1,563,365 | 12/1925 | Hollup . | |
| 2,838,883 | 6/1958 | Hall . | |
| 2,927,679 | 3/1960 | Rively . | |
| 2,974,774 | 3/1961 | Stuart | 198/394 |
| 3,236,374 | 2/1966 | Zimmerman et al. . | |
| 3,376,851 | 4/1968 | Schlemm et al. . | |
| 3,437,189 | 4/1969 | Molins | 198/428 |
| 3,501,870 | 3/1970 | Bottomley | 198/346.2 |
| 3,837,472 | 9/1974 | Byerly | 198/430 |
| 3,972,407 | 8/1976 | Kushigian | 198/347.2 |
| 4,173,100 | 11/1979 | MacBroom, Jr. . | |
| 4,177,682 | 12/1979 | Blackman . | |
| 4,216,628 | 8/1980 | Wada . | |
| 4,327,825 | 5/1982 | Ackley et al. | 198/397 |
| 4,573,863 | 3/1986 | Picotte . | |
| 4,832,174 | 5/1989 | Frisbie | 198/384 |
| 4,892,182 | 1/1990 | Gustafsson | 198/397 |
| 4,982,553 | 1/1991 | Itoh | 198/346.2 |
| 5,001,323 | 3/1991 | Matsutani et al. . | |
| 5,038,914 | 8/1991 | Cotic et al. | 198/393 |
| 5,155,943 | 10/1992 | Matsutani et al. . | |
| 5,250,008 | 10/1993 | Lange | 198/456 |

FOREIGN PATENT DOCUMENTS

| | | | |
|---|---|---|---|
| 251466 | 1/1967 | Austria | 198/456 |
| 0437329 | 7/1991 | European Pat. Off. . | |
| 2673921 | 9/1992 | France . | |

OTHER PUBLICATIONS

Patent Abstracts of Japan, vol. 9, No. 179 (M–399)(1902), Jul. 24, 1985.

*Primary Examiner*—Joseph E. Valenza

[57] ABSTRACT

An apparatus for transporting surgical needles includes a needle holding apparatus having a movable jaw structure. The jaw structure is releasably biased in a closed position for holding needles in a predetermined position. The jaw structure may include laterally movable first and second sections for rotating a needle therebetween. The needle holding apparatus may be removably positionable on a work surface such that the needle holding apparatus may interface with a needle loading apparatus. The needle loading apparatus provides accommodating means capable of containing a multiplicity of needles. A needle advancing structure, such as a movable track, advances the needles in a predetermined fashion from the accommodating means. The needle advancing structure positions needles such that said jaw structure of the holding apparatus can selectively grasp the needles and transport the needle to another location. An alternative embodiment of a needle holding apparatus includes first and second independently movable jaw structures. The jaw structures are selectively and independently actuable into open and closed positions. The first jaw structure may include laterally movable first and second sections for rotating a needle therebetween. The needle transporting apparatus may further provide a calibrating apparatus having a mounting surface. The calibrating apparatus includes a gauge for measuring lateral motion of the jaw structure of the holding apparatus.

16 Claims, 28 Drawing Sheets

240
280
285
281
244
292
252
254
256
246
284
247
248

NEEDLE TRANSPORTING APPARATUS

This is a continuation of application Ser. No. 08/131,908, filed on Oct. 5, 1993, abandoned which is a divisional of Ser. No. 07/959,151 filed on Oct. 9, 1992, now issued as U.S. Pat. No. 5,282,715.

BACKGROUND OF THE INVENTION

1. Field of the Invention

The present invention relates to needle transporting apparatus and, more particularly, to needle transporting apparatus which positions surgical needles for a removable holding apparatus, and includes a holding apparatus calibrating device.

2. Description of the Related Art

Surgical needle manufacture is a precise and time consuming procedure, particularly where individual needles are formed one at a time. Conventional surgical needle manufacturing typically begins with the step of cutting round wire stock to a predetermined length. A working end of the stock is then tapered to provide a cutting edge while the opposite end may be manipulated or worked to attain a flattened or other predetermined shape. Later, typically after almost all of the needle working is completed, the stock is cut to its final length and then prepared for suture attachment. The needle may then be subjected to processing such as grinding, and/or polishing a cutting edge, as well as hardening.

Conventional needle processing is, in large part, a manual operation. The needles are typically transported to different stations for each stage of the processing procedure. Transporting needles, for example, typically may include manually grasping needles using a hand held device. The grip on the needles and the positioning of the needles is visually evaluated and/or confirmed.

The needles are then manually transported to a processing station, such as, a needle station for grinding a cutting edge on a needle. Securely grasping and positioning needles can be critical when the needles are subjected to such processing. It is therefore desirable for the needles to be ill a predetermined position for processing and for the needles to remain stationary while processing is occurring. Inaccurate positioning or movement of the needle can compromise accuracy of needle processing procedures and the quality of the refilled needles.

More specifically, the needle(s) may be held by a pliers-like device or a chuck which grips the opposite end of the needle from the working end. Usually, no more than two needles can be held in the device at one time for processing the needle(s). The pliers-like device or chuck may be used, for example, to manually engage the needle working end with a rotating abrasive belt to fashion a desired cutting edge.

One disadvantage to conventional needle transporting devices is that only one or two needles at a time can be positioned for processing using a chuck. Further, positioning needles for processing at a work station can be irregular when relying on visual monitoring. Additionally, manually holding needles for processing can result in undesirable movement of the needles. Needle movement may result in inconsistent and unwanted needle refinement. Further, manually positioning needles for processing can be inefficient. Finally, substantially no automation of needle transporting steps is provided in previous devices.

It would therefore be desirable to provide a needle transporting device which addresses these shortcomings in the art by having the capacity to transporting a multiplicity of needles simultaneously. It would also be desirable to provide a needle transporting device which facilitates ease of operation and is efficient. It would also be desirable to provide a needle transporting device capable of grasping and holding needles in a predetermined manner without the necessity of visual monitoring. It would further be desirable to provide a needle transporting device which can selectively rotate needles held in a predetermined manner. It would also be desirable to provide a needle transporting device which discourages unwanted irregularities to the cutting edge of a needle. It would further be desirable to provide a needle processing device which can be substantially automated in an efficient manner.

SUMMARY OF THE INVENTION

An apparatus for transporting surgical needles is provided which includes a needle holding apparatus having a movable jaw structure. The jaw structure is releasably biased in a closed position for holding needles in a predetermined position. An actuation means is provided for selectively and remotely actuating the jaw structure between closed and open positions. The needle holding apparatus may further provide jaw structure having laterally movable first and second sections for rotating a needle therebetween.

The needle holding apparatus may be removably positionable on a work surface such that the needle holding apparatus interfaces with a needle loading apparatus.

The needle loading apparatus provides accommodating means capable of containing a multiplicity of needles. An advancing structure, such as a movable track, advances the needles in a predetermined fashion from the accommodating means. The advancing structure positions needles such that the jaw structure of the holding apparatus can selectively grasp the needles and transport the needles to another location.

The needle transporting apparatus may further provide a calibrating apparatus having a mounting surface. The calibrating apparatus includes a gauge for measuring lateral motion of the jaw structure of the holding apparatus.

BRIEF DESCRIPTION OF THE DRAWINGS

The foregoing features of the present invention will become more readily apparent and will be understood by referring to the following detailed description of preferred embodiments of the invention, which are described hereinbelow with reference to the drawings wherein.

DETAILED DESCRIPTION OF THE PREFERRED EMBODIMENTS

Figure 1:
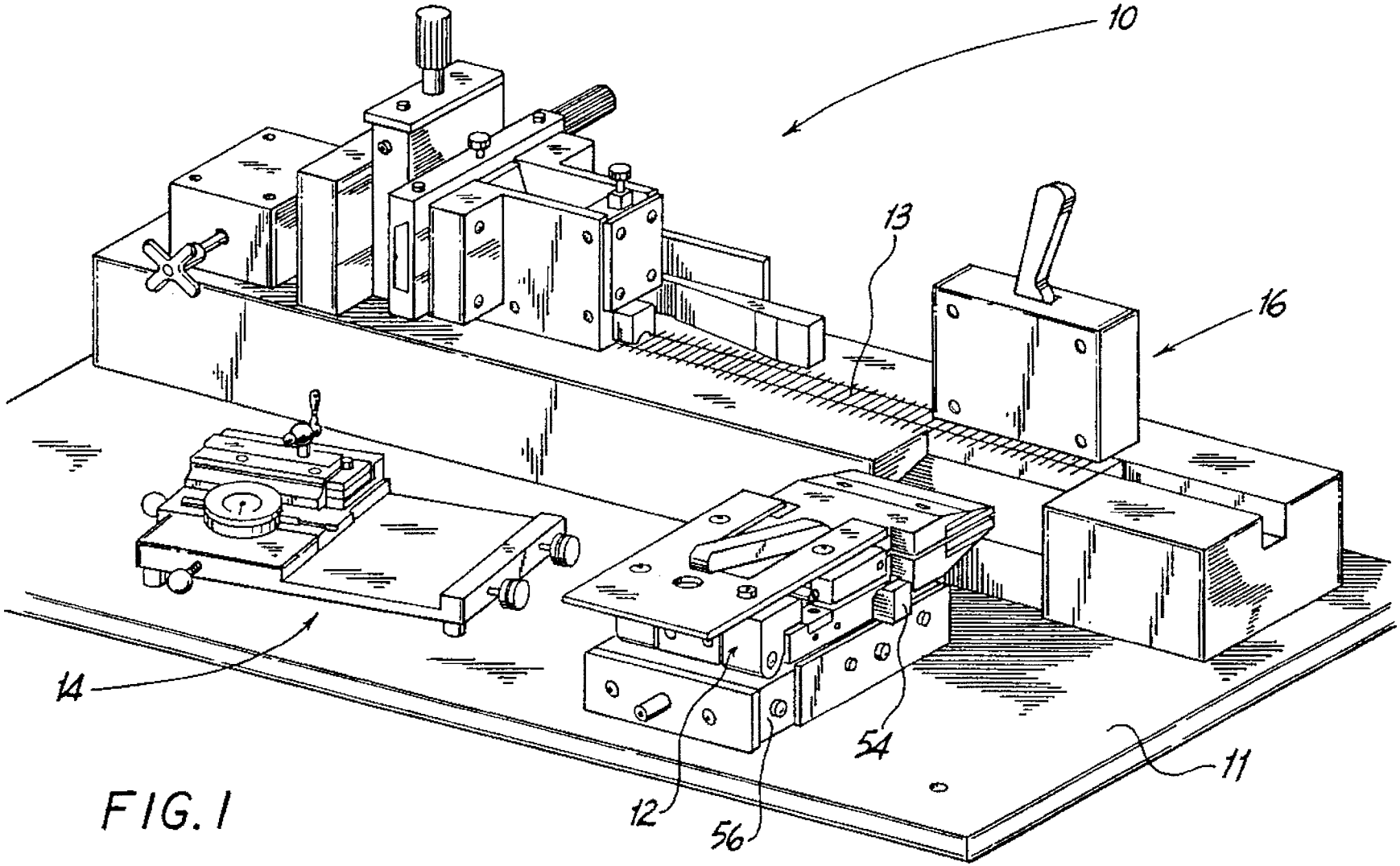
FIG. 1 is a perspective view illustrating a needle transport assembly including holding apparatus, calibrating apparatus, and loading apparatus according to one embodiment of the present invention.
Figure 2:
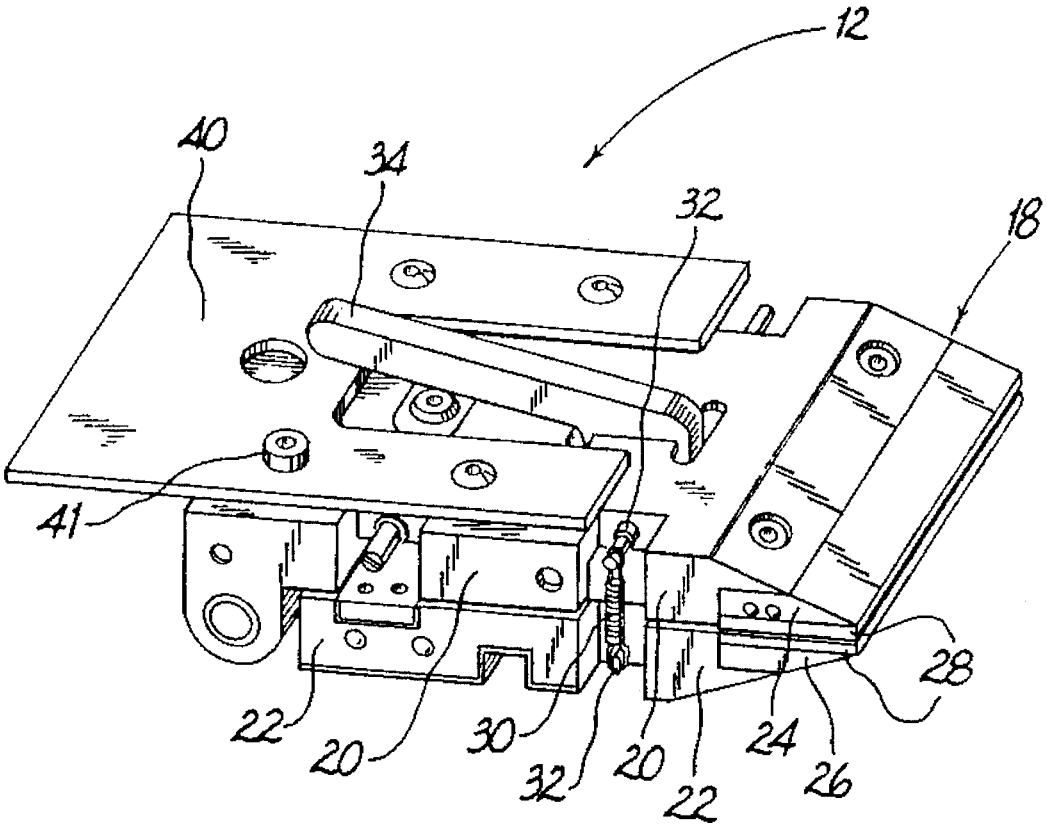
FIG. 2 is a perspective view illustrating the holding apparatus shown in FIG. 1.

Referring to the drawings, in which like reference numerals identify identical or similar elements. FIGS. 1–31 illustrate preferred embodiments of a needle transport assembly 10. The needle transport assembly includes a holding apparatus 12, a calibrating apparatus 14, and a loading apparatus 16.

Referring to FIGS. 1–7, a needle transporting apparatus 10 is shown comprising a holding apparatus 12 which includes an upper portion 20 and a lower portion 22 in overlapping relation. The holding apparatus further includes jaw structure 18 adapted for holding up to a multiplicity of needles 13 for transporting. The jaw structure 18 defines the front of the holding apparatus, and the opposite end of the holding apparatus from the front defines the back of the holding apparatus. Both the front and back of the holding apparatus 12 are referred to herein for reference.

The jaw structure 18 includes an upper section 24 which is integral with the upper portion 20, and further includes a lower section 26 which is integral with the lower portion 22. The upper and lower sections 24, 26 of the jaw structure 18 are movable between open and closed positions. The upper and lower jaw sections 24, 26 work in concert to hold needles 13 therebetween when in the closed position. Once the needles 13 are positioned between the jaws, transport of the needles 13 held in the jaw structure 18 is possible.

It also contemplated that the upper and lower jaw sections 24, 26 may be of a different material than the rest of the holding apparatus. Preferably, the upper and lower jaw sections 24, 26 include needle contacting material 28 where the jaws are intended to contact needles 13. A needle 13 positioned between the jaw material 28 will remain substantially unchanged or undamaged. The contacting material 28 preferably is an elastomeric material such as, for example, neoprene, rubber or urethanes.

Figure 3:
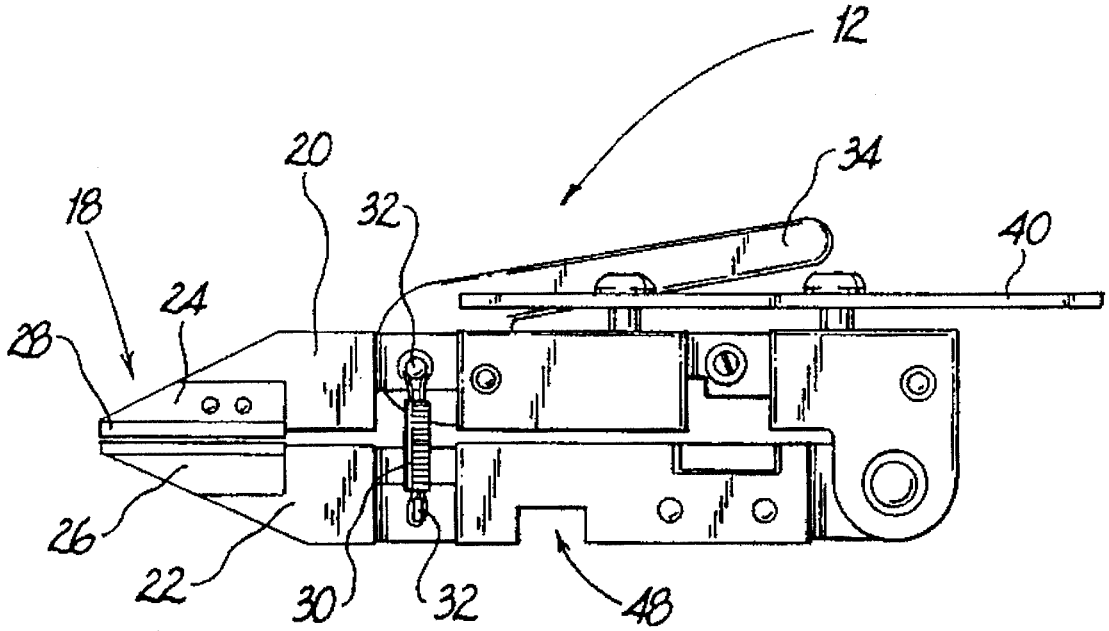
FIG. 3 is a side elevational view of the holding apparatus shown in FIG. 2.

The holding apparatus upper portion 20 and the lower portion 22 are spring biased in overlapping relation to each other by springs 30. The springs 30 are positioned on both sides of the holding apparatus 12 and are attached thereto by pins 32. The springs 30 normally bias the upper and lower jaw sections 24, 26 in a closed position (FIG. 3). The holding apparatus 12 further includes an actuation lever 34 for opening the jaw structure 18 by separating the upper and lower jaw sections 24, 26. The actuation lever 34 is positioned along a central longitudinal axis extending through the holding apparatus 12. The lever 34 provides a remote actuating means for moving the jaw section 24, 26 into open and closed positions. The jaw actuation lever 34 is pivotably mounted on a pivot rod 46 which extends through the upper portion of the holding apparatus.

Figure 4:
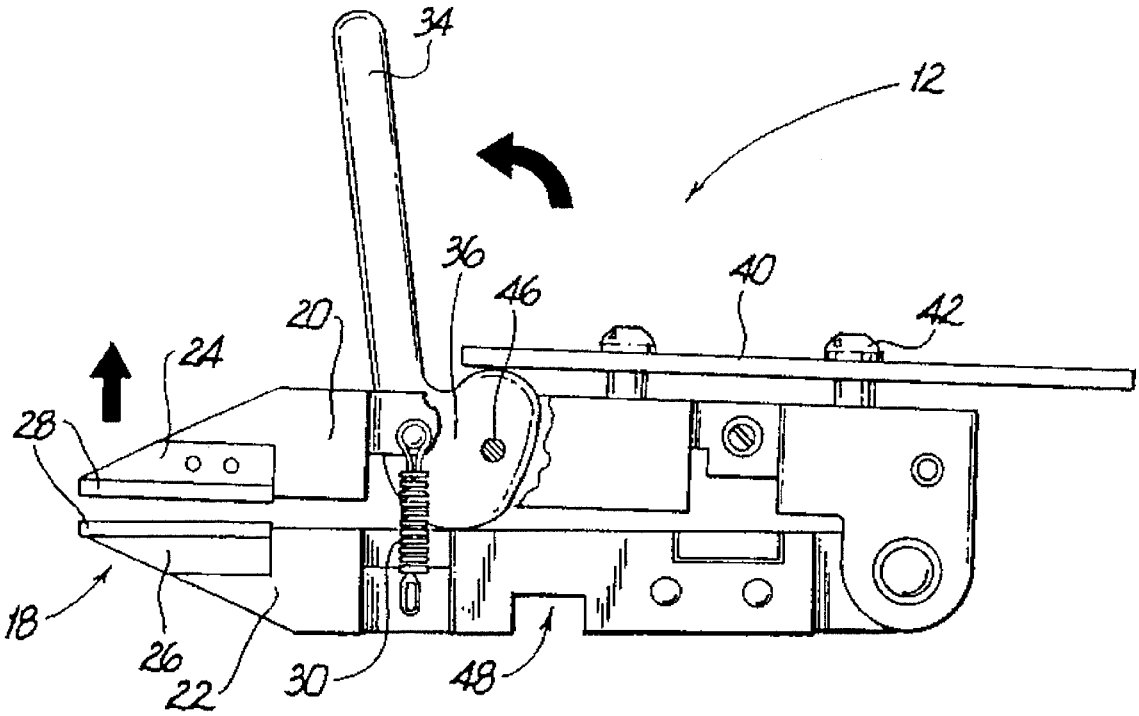
FIG. 4 is a side elevational view of the holding apparatus shown in FIG. 2 having jaw structure in an open position.
Figure 5:
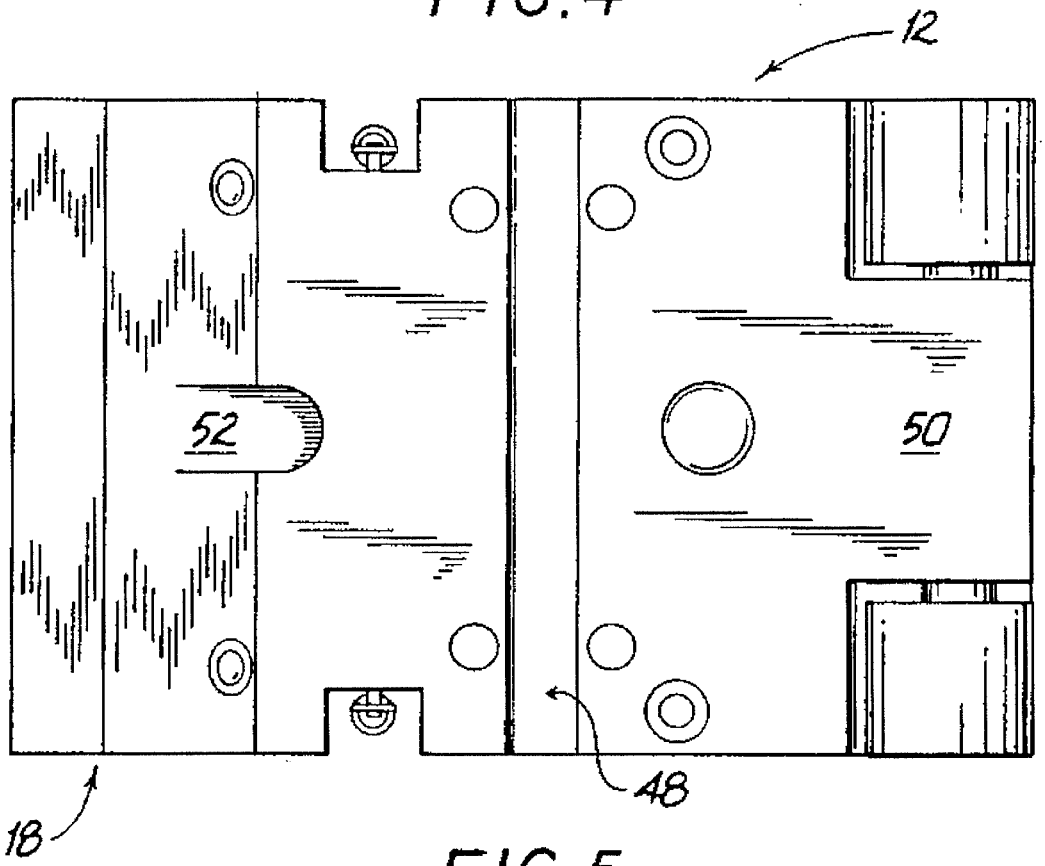
FIG. 5 is a bottom plan view of the holding apparatus shown in FIG. 2.

The actuation lever 34 includes a camming portion 36, shown in FIG. 4. The camming portion 36 contacts the camming surface 38, shown in FIG. 6, when the actuation lever 34 is moved towards the front of the holding apparatus 12. This movement of the actuation lever 34 causes contact between the camming portion 36 and the camming surface 38 to separate the first and second portions 20, 22, opening the jaw structure 18.

A locking plate 40 is positioned on the outer side of the upper portion 20. The locking plate 40 is fastened to the upper portion by fasteners 42. The locking plate 40 partially overhangs the back end of the upper portion 20. Preferably a cylinder (not shown) may be applied to the underside of the overhanging portion of the locking plate 40 to insure that the upper section 24 and the lower section of the jaw structure 18 are in the closed position, as shown in FIG. 3.

A groove 48 extends across the bottom 50 of the lower portion 22 of the holding apparatus 12. The groove 48 mates with a positioning bar 54 on a mounting structure 56, shown in FIGS. 1 and 10. A mount 41 is positioned on the upper portion 20 of the holding apparatus 12. The mount is used for moving the upper portion 20 when calibrating the lateral movement of the upper portion 20 with respect to the lower portions 22, as described below.

A notch 52 is positioned in the bottom 50 of the lower portion of the holding apparatus 12. Notch 52 is matable with a member on a mounting structure, such as, for example, the mounting structure 56 shown in FIG. 10. The notch 52 and mating member encourage positive and fixed positioning of the holding apparatus 12 to a mounting structure.

Figure 6:
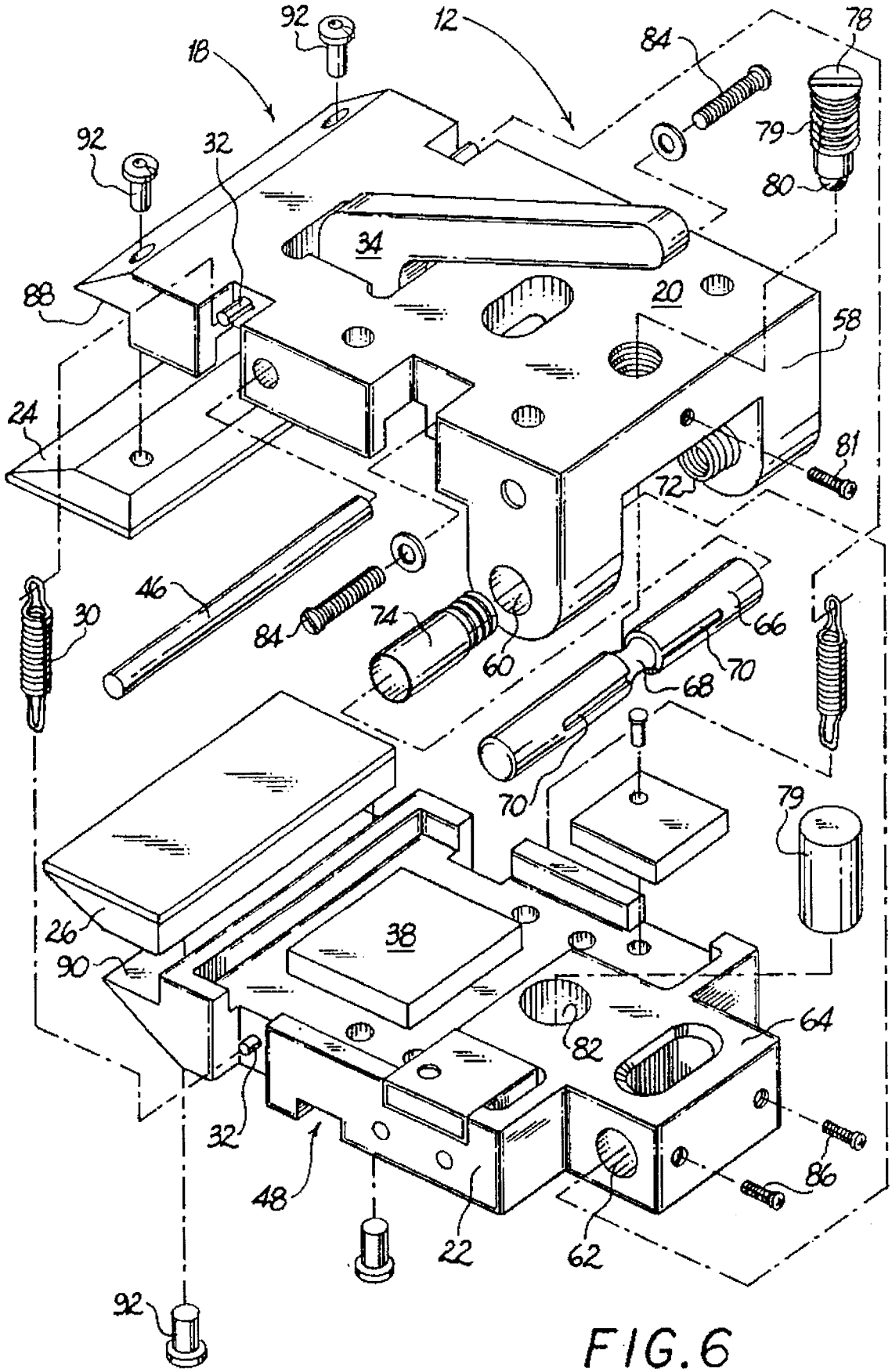
FIG. 6 is an exploded perspective view of the holding apparatus shown in FIG. 2.
Figure 7:
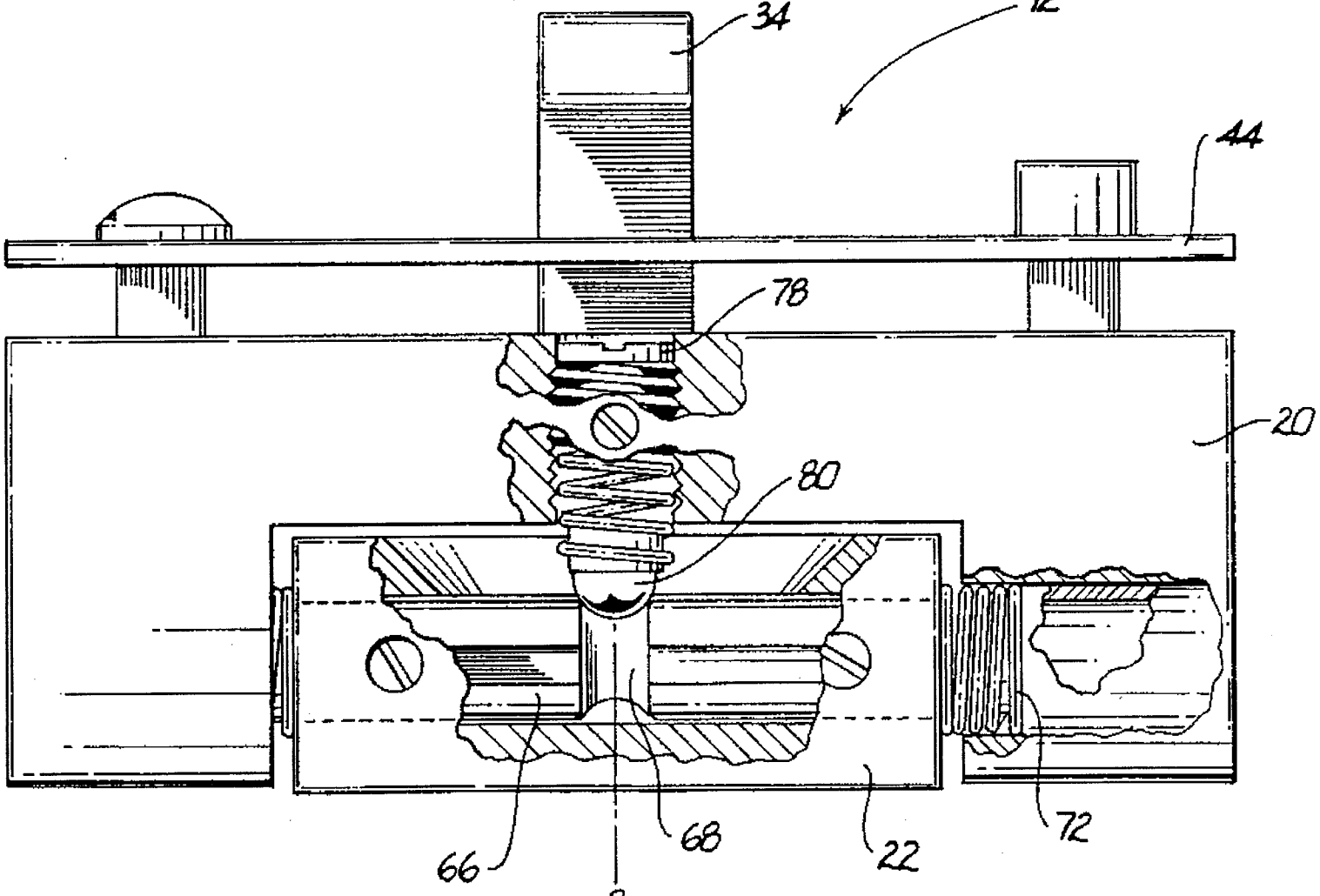
FIG. 7 is a rear elevational view of the holding apparatus shown in FIG. 2.

Referring to FIG. 6, the upper jaw section 24 of the upper portion 20 mates with an "L" shaped receiving groove 88 towards the front of the upper portion 20. The lower jaw section 26 of the lower portion 22 mates with an "L" shaped receiving groove 90 towards the front of the lower portion 90. Pins 92 connect the upper and lower jaw sections 24, 26 within the "L" shaped receiving grooves 88, 90.

The upper portion 20 further includes an upper axle holding section 58 toward the back of the holding apparatus 12. The upper axle holding section 58 includes an aperture 60 extending therethrough. The lower portion 22 of the holding apparatus 12 includes an aperture 62 extending through a lower axle holding section 64 which is in axial communication with the aperture 60 of the upper axle holding section 58. An axle 66 is positioned through the apertures 60 and 62 of the upper and lower axle holding sections 58, 64. The axle 66 includes a middle indented portion 68 and an elongated longitudinal slot 70.

On each side of axle 66 are lateral biasing springs 72 and bushings 74 fixedly placed within the aperture 60 of the upper axle holding section 58. The axle 66 is positioned between the springs 72 and bushings 74. Thus, the upper portion 20 may be moved laterally with respect to the lower portion 22 while being biased in a central location by the lateral biasing springs 72.

A threaded hole 76 is positioned toward the back of the upper portion 20 and receives a tension adjustment pin 78 having a mating threaded portion 79. The tension adjustment pin 78 includes a ball bearing 80 at its lower end which contacts the indented middle portion 68 of axle 66. The indented middle portion 68 accommodates the ball bearing 80 to affirmatively bias the upper portion 20 to a central location with respect to lower portion 22.

A set screw 81 locks the tension adjustment pin 78 positioned along the longitudinal slot 70. The set screw 81 locks the tension adjustment pin 78 in position after the pin 78 is screwed up or down to adjust the tension on the axle 66. Further, axle set screws 86 are positioned in the back of the lower portion 22 for holding the axle 66 in place by contacting the longitudinal slots 70 in the axle 66.

An abutment pin 79 is positioned in a hole 82 in the lower portion 22. The abutment pin 79 is positioned such that adjustment screws 84 contact the abutment pin 79 when the upper portion 20 is moved laterally in relation to the lower portion 22. More specifically, since the adjustment screws 84 are connected to the upper portion 20, each adjustment screw 84 can be positioned to contact the abutment pin 79 at selectable locations of the upper portion 20. Thus, the upper portion 20 can be laterally moved to selectable positions defined by the adjustment screws 84.

Thus, needles held between the jaw sections 24, 26 can be rotated by laterally moving the upper portion 20 relative to the lower portion 22. The desired angular rotation of the needles 13 is regulated by altering the adjustment screws 84 to arrange the magnitude of lateral motion of the upper portion 20.

Figure 8:
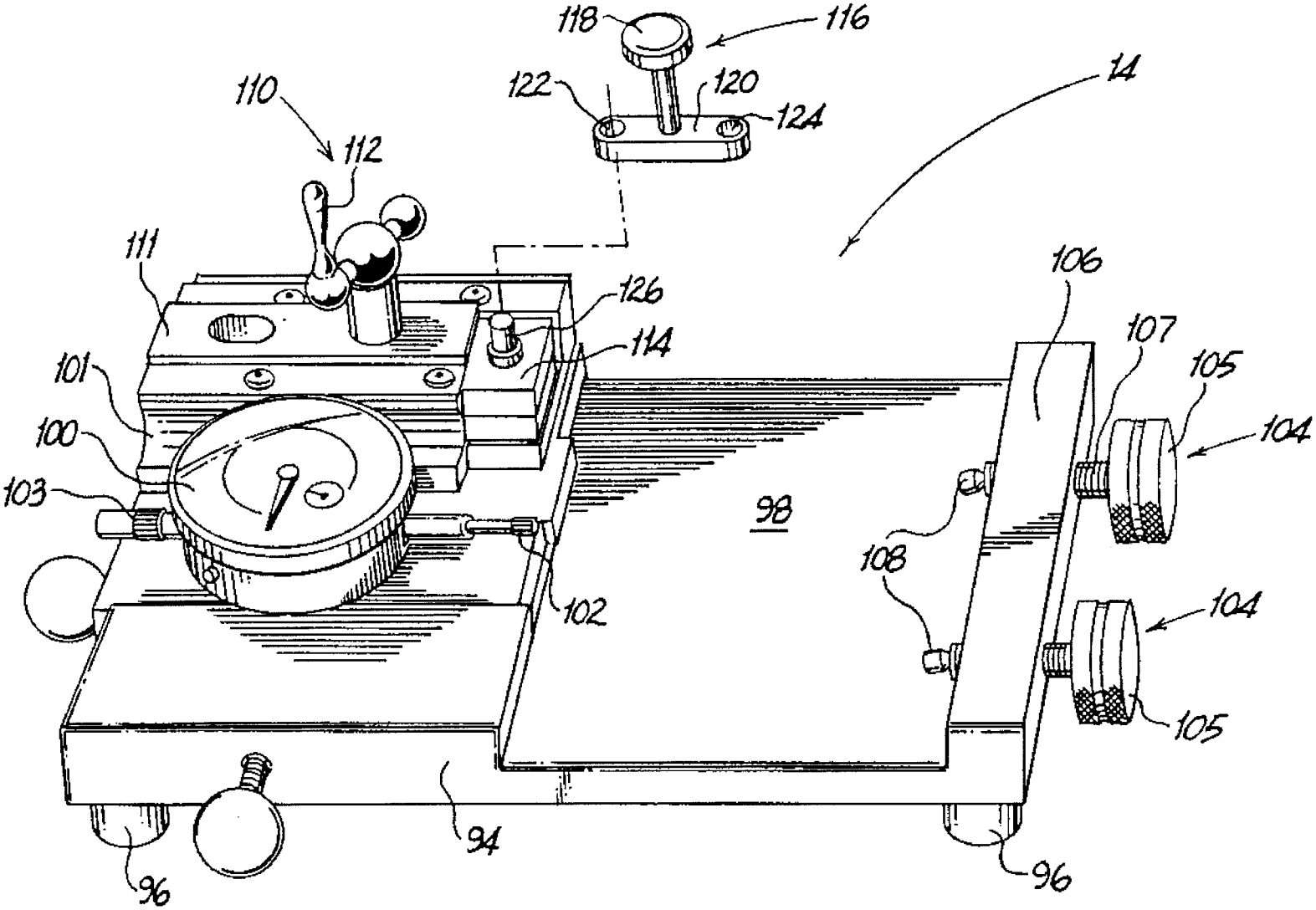
FIG. 8 is a perspective view of the calibrating apparatus shown in FIG. 1.
Figure 9:
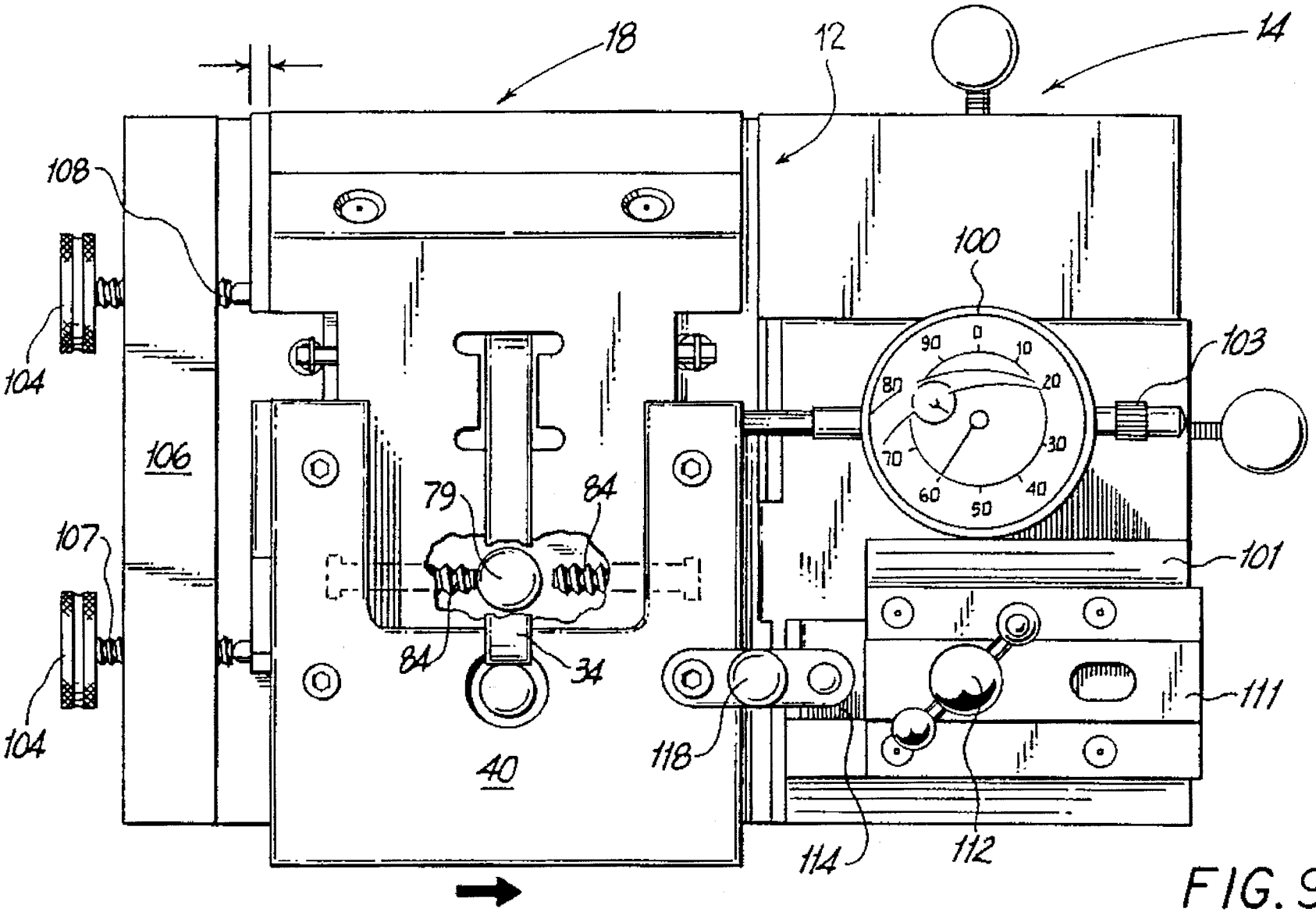
FIG. 9 is a top view illustrating the calibrating apparatus of FIG. 8 with the holding apparatus of FIG. 2 mounted thereon.

Referring to FIGS. 8 and 9, the needle transporting apparatus 10 also includes a calibrating apparatus 14. The calibrating apparatus 14 is dimensioned and configured to accommodate the needle holding apparatus 12 for calibration. Specifically, the calibrating apparatus 14 includes a frame 94 having legs 96 such that the calibrating apparatus 14 can be positioned on a work surface 11 or the like. The frame 94 of the calibrating apparatus 14 includes a mounting surface 98 configured and dimensioned for receiving the holding apparatus 12 in a predetermined manner.

A calibrating meter 100 is mounted on the frame 94. The calibrating meter 100 includes a contacting member 102 positioned proximate the mounting surface for contacting the holding apparatus 12 placed thereupon. A calibrating knob 103 is positioned opposite the contacting member 102 for selectively approximating the contacting member 102 towards and away from the holding apparatus 12 positioned on the mounting surface 98.

The calibrating meter 100 visually indicates the relative motion of the contacting member 102, and thereby, the relative motion of, for example, the upper portion 20 of the holding apparatus 12 communicating with the contacting member 102. The relative motion is preferably measured by the calibrating meter 100 in increments of mils.

A curved portion 101 is positioned between the mounting structure 111 and the calibrating meter 100. An adjustment tool, such as a screw driver or allen key, is guided by the curved portion 101 to meet with the adjustment screws 84 of the holding apparatus 12. The adjustment screws 84 can then be arranged to set the lateral motion of the upper portion 20 of the holding apparatus 12, as described above.

Stabilizers 104, functioning as retaining means, are positioned through a side wall 106 of the frame 94 opposite the calibrating meter 100. The stabilizers include knobs 105, threaded portion 107, and contacting portions 108 opposite the knobs 108. The contacting portions 108 are positioned against the holding apparatus 12 placed on the mounting surface 98 to secure the holding apparatus 12 in position.

A calibrating mechanism 110 is positioned on the frame 94 proximate the calibrating meter 100. The calibrating mechanism 110 includes a rotatable actuation knob 112 positioned on a mounting structure 111. A slide member 114 is positioned at least partially within the mounting structure 111. The actuation knob 112 selectively moves the slide member 114 laterally, that is, towards and away from the side wall 106.

A fastening structure 116, also functioning as a retaining means or grasping member, includes a knob 118 and a body portion 120 having first and second apertures 122, 124. The first aperture 122 is pivotally positioned on pivot mount 126. The second aperture 124 is removably positioned on mount 41 of the needle holding apparatus 12. The knob 118 is used to rotate the fastening structure 116 about the pivot mount 126 such that the body portion 120 of the fastening structure 116 can be connected to the mount 41 on the holding apparatus 12.

In operation, the calibrating apparatus 14 may first be used to calibrate the holding apparatus 12 for appropriately rotating needles held in its jaw structure 18. The calibrating apparatus 14 accommodates the holding apparatus 12 on its mounting surface 98, as shown in FIG. 9. The fastening structure 116 is pivoted about the pivot mount 126 to attach the second aperture 124 to the mount 41 on the holding apparatus 12. The stabilizing knobs 105 are rotated to position the contacting portions 108 against the holding apparatus 12, thereby, securing the holding apparatus 12 in position on the mounting surface 98. The calibrating actuation knob 112 may then be turned to move the upper portion 20 of the holding apparatus 12 connected to the slide member 114. The upper portion 20 may be moved laterally in both directions by changing the direction of rotation of the knob 112.

As the upper portion 20 is moved by the slide member 114, the calibrating knob 103 may be actuated to position the calibrating contacting portion 102 against the upper portion 20 of the holding apparatus 12. The calibrating meter 100 visually displays the incremental movement of the upper portion 20 of the holding apparatus via the placement of the calibrating contacting member 102.

The adjustment screws 84 can then be accessed using a screw driver or the like, guided by the curved portion 101 to access one adjustment screw 84. The other adjustment screw 84 is accessed for adjustment over the side wall 106.

After the calibration of the holding apparatus 12 is completed by positioning the adjustment screws 84 of the holding apparatus 12, the stabilizing knobs 104 and the fastening structure 116 can be released by reversing the procedure described above. The holding apparatus 12 can then be removed from the mounting surface 98 of the calibrating apparatus 14.

LOADING APPARATUS

Figure 10:
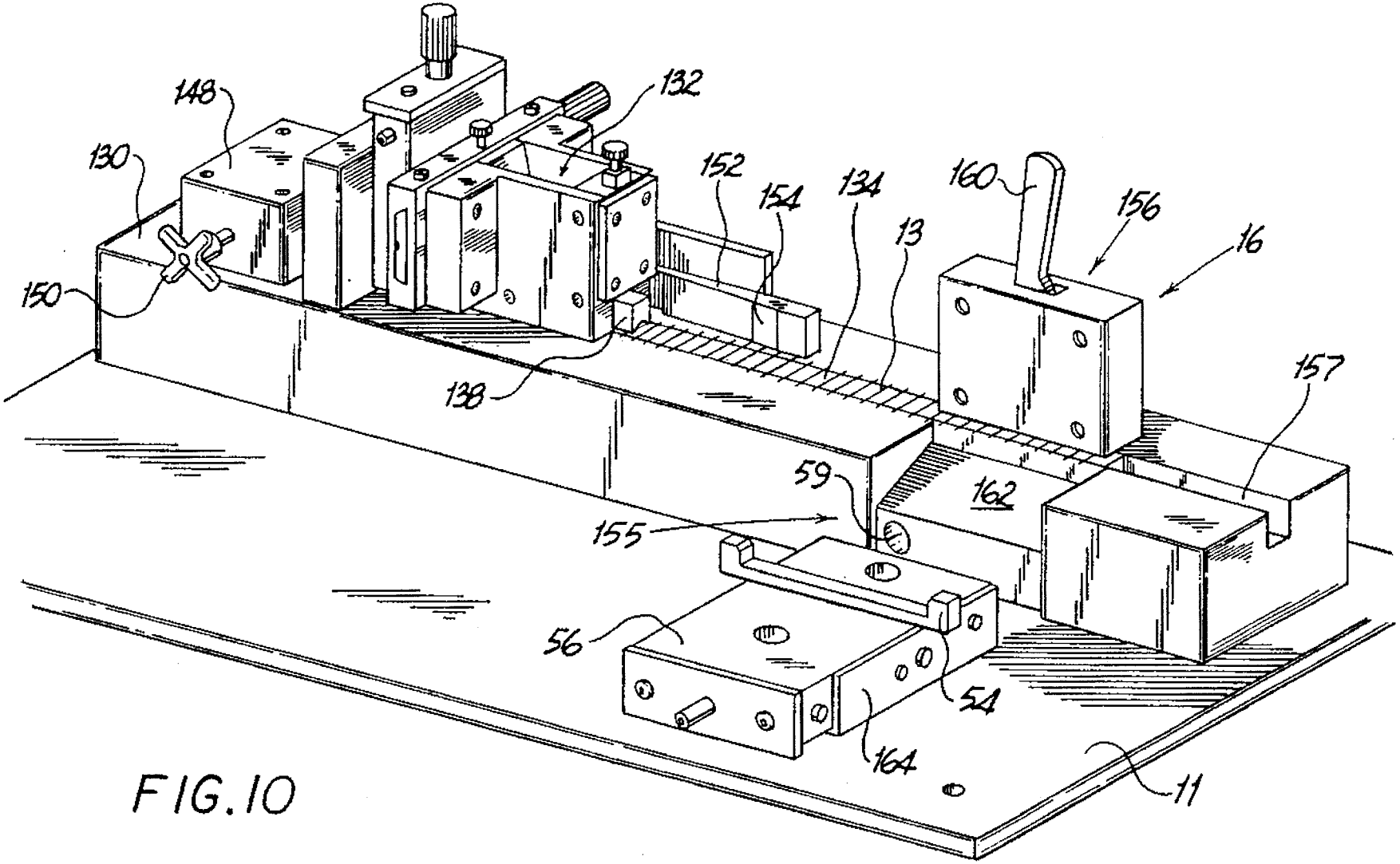
FIG. 10 is a perspective view of the loading apparatus shown in FIG. 1.
Figure 11:
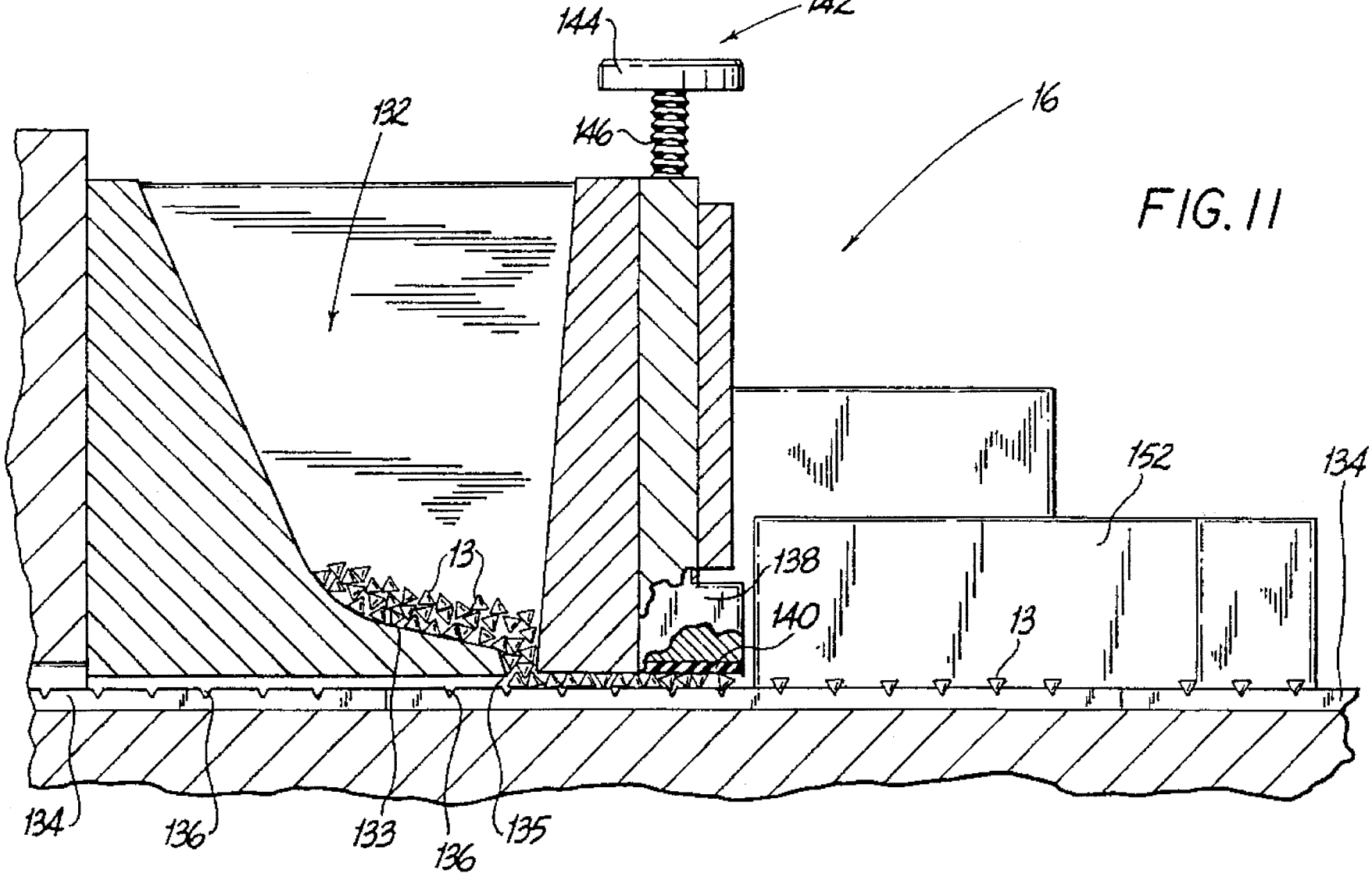
FIG. 11 is an enlarged side elevational view illustrating the loading apparatus shown in FIG. 10.

Referring to FIGS. 10–15, the needle transporting apparatus includes a loading apparatus 16 for loading needles into the holding apparatus 12. The loading apparatus 16 includes a frame 130 positioned on the work surface 11, as shown in FIGS. 10 and 11. The loading apparatus 16 includes a needle receptacle 132 positioned towards one end of the frame 130, and a loading station 155 positioned distal to the needle receptacle 132. Further, the frame 130 includes a longitudinally extending slot 157 which slidably accomondates the track 134. The track 134 can be moved in the slot 157, and removed after being extended through the end of the slot 157 proximate the loading station 155. The track 134 can then be loaded into the opposite end of the slot 157 to be reloaded with needles 13.

The needle receptacle 132 is dimensioned and configured for accommedating a multiplicity of needles 13. It is envisioned that the needle receptacle 132 is a preferred embodiment of a storing member or accommodating means for holding needles. The receptacle 132 includes a sloped portion 133 for encouraging the needles 13 through an opening 135 in the receptacle 132. The receptacle 132 thereby deposits the needles 13 onto the track 134 in a predetermined fashion, as shown in FIG. 11.

Referring now to FIG. 11, the track 134 functions as a movable member for advancing the needles 13 along a predetermined track path from the needle receptacle 132. The track 134 extends along the frame 130 about a longitudinal axis extending through the frame 130. The track 134 includes a plurality of equidistant spaced grooves 136. The grooves 136 are have a generally "V" shaped configuration such that a triangular portion of a needle will mate with the groove 136. It is also contemplated that grooves having other shapes may be acceptable for mating with alternatively shaped needles or needle stock, such as, a generally "U" shaped groove.

The needle receptacle 132 includes a positioning member 138, which is envisioned as a preferred embodiment of a positioning means, for rotating the needles 13 to the appropriate position to mate with the grooves 136. The positioning member 138 includes a contacting clement 140 for communicating with needles 13 that are not positioned with the grooves 136 in the appropriate manner. The contacting element 140 contacts the needles 13 and, rotates them until they fit into grooves 136 in the track 134.

An adjustment member 142 includes a rotatable knob 144 and a threaded portion 146. The adjustment member 142 is connected to the positioning member 138 to elevate and descend the contacting element 140 to an appropriate height above the track 134.

Referring back to FIG. 10, a track actuation mechanism 148 includes a rotatable knob 150 communicating with the track 134. Rotation of the knob 150 moves the track 134 toward the loading station 155. The actuation mechanism, and track 134, may both be considered part of an advancing structure for moving the needles 13 in an orderly and predictable fashion to the loading station.

An aligning block 152 is positioned along side of the track 134 and has a frontally inclined surface 154. The inclined surface 154 contacts the needles 13 as they are advanced toward the loading station 155 on the track 134. The inclined surface substantially insures that the needles 13 are aligned evenly with respect to each other on the track 134.

The needles 13 positioned in the grooves 136 on the track 134 are advanced until situated at the loading station 155. The loading station 155 includes a retaining structure 156 having a needle contacting portion 158, shown in FIGS. 14 and 15. The needle contacting portion 158 is substantially non-abrasive and may be composed of, for example, an elastomeric material.

The loading station 155 further includes a sloped portion 162. (See FIGS. 10 and 12) The sloped portion 162 allows the holding apparatus 12 positioned on the mounting surface 56 to approach the needles 13 held by the retaining structure 156.

The retaining structure 156 includes an actuation lever 160 which approximates the needle contacting portion 158 onto the needles 13 on the track 134.

The contacting portion 158 thereby holds the needles 13 on the track in their predetermined position in the grooves 136.

Referring to FIG. 10, the loading apparatus includes a mounting structure 56 dimensioned and configured for accommodating the holding apparatus 12. The mounting structure 56 includes a frame 164 having the mounting structure slidably positioned therein. The mounting structure 56 further includes the positioning bar 54 which mates with the groove 48 in the holding apparatus 12.

Figure 13:
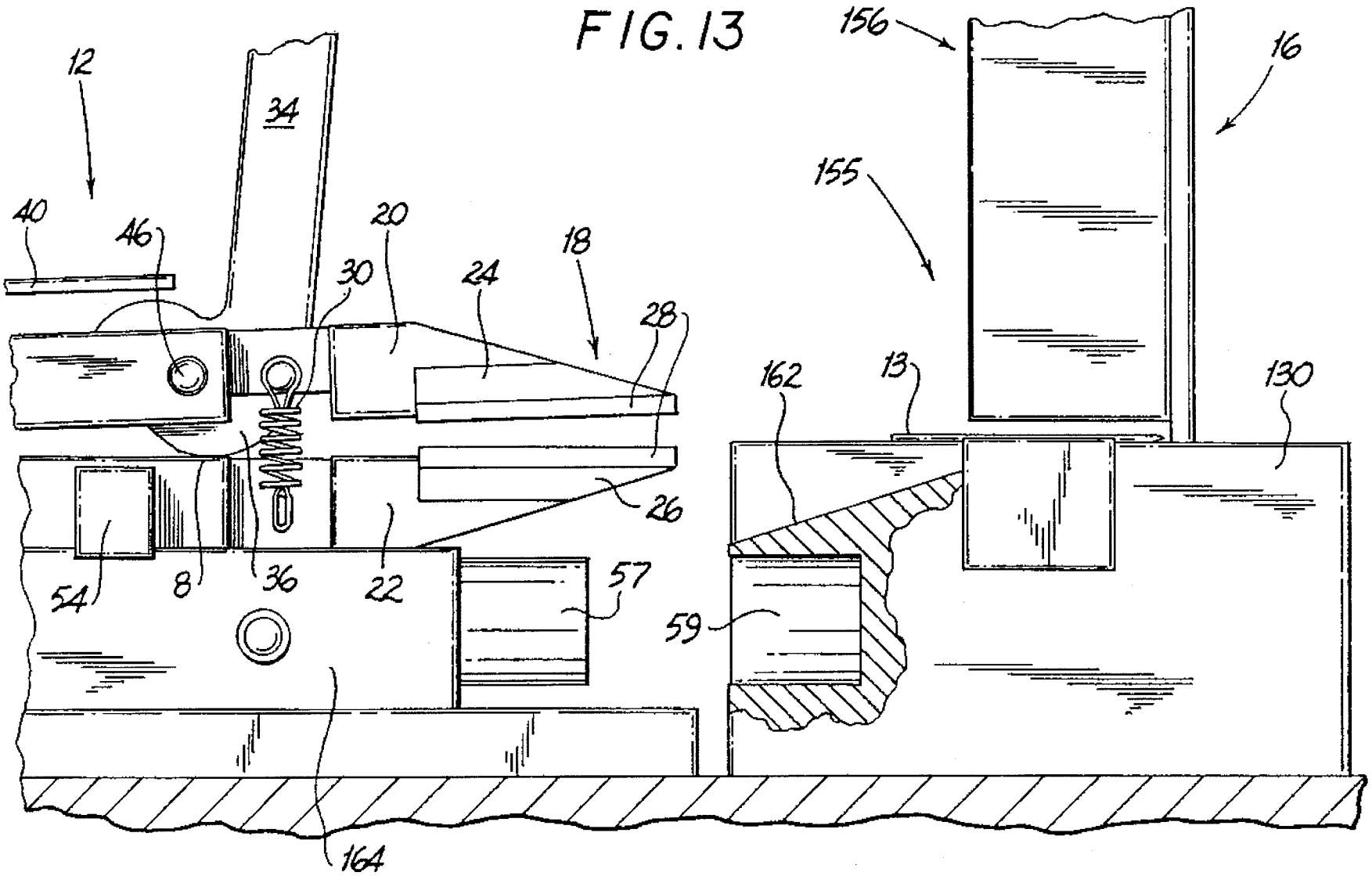
FIGS. 13–15 are side elevational views illustrating the needle loading apparatus during a sequence of operation.
Figure 14:
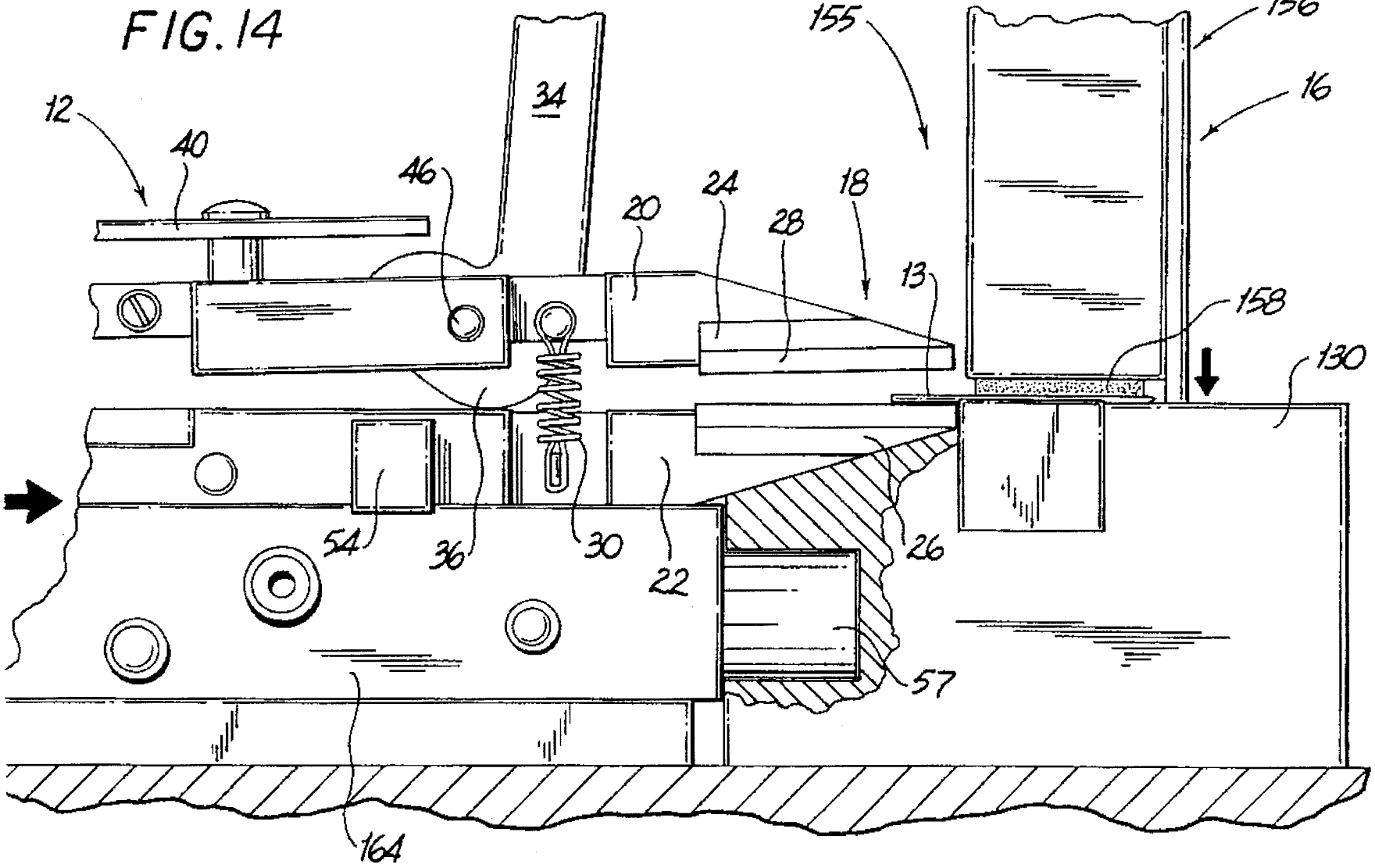

The mounting structure 56 is movably positioned on the work surface 11. The mounting structure 56 slides in a generally orthogonal direction with respect to the loading station 155. The mounting structure 56 thus is positioned such that the needle holding apparatus 12, when positioned on the mounting structure 56, can slide towards the loading station 155. The needles 13 positioned at the loading station 155 can be placed between the open jaw structure 18 of the holding apparatus 12. As illustrated in FIGS. 13 and 14, to ensure proper positioning of the holding apparatus 12 when positioning needles 13 in the jaw structure 18, the mounting structure 56 includes a cylindrical alignment projection 57. The projection 57 mates with a cylindrical hole 59 in the frame 130 of the loading apparatus 16.

Figure 12:
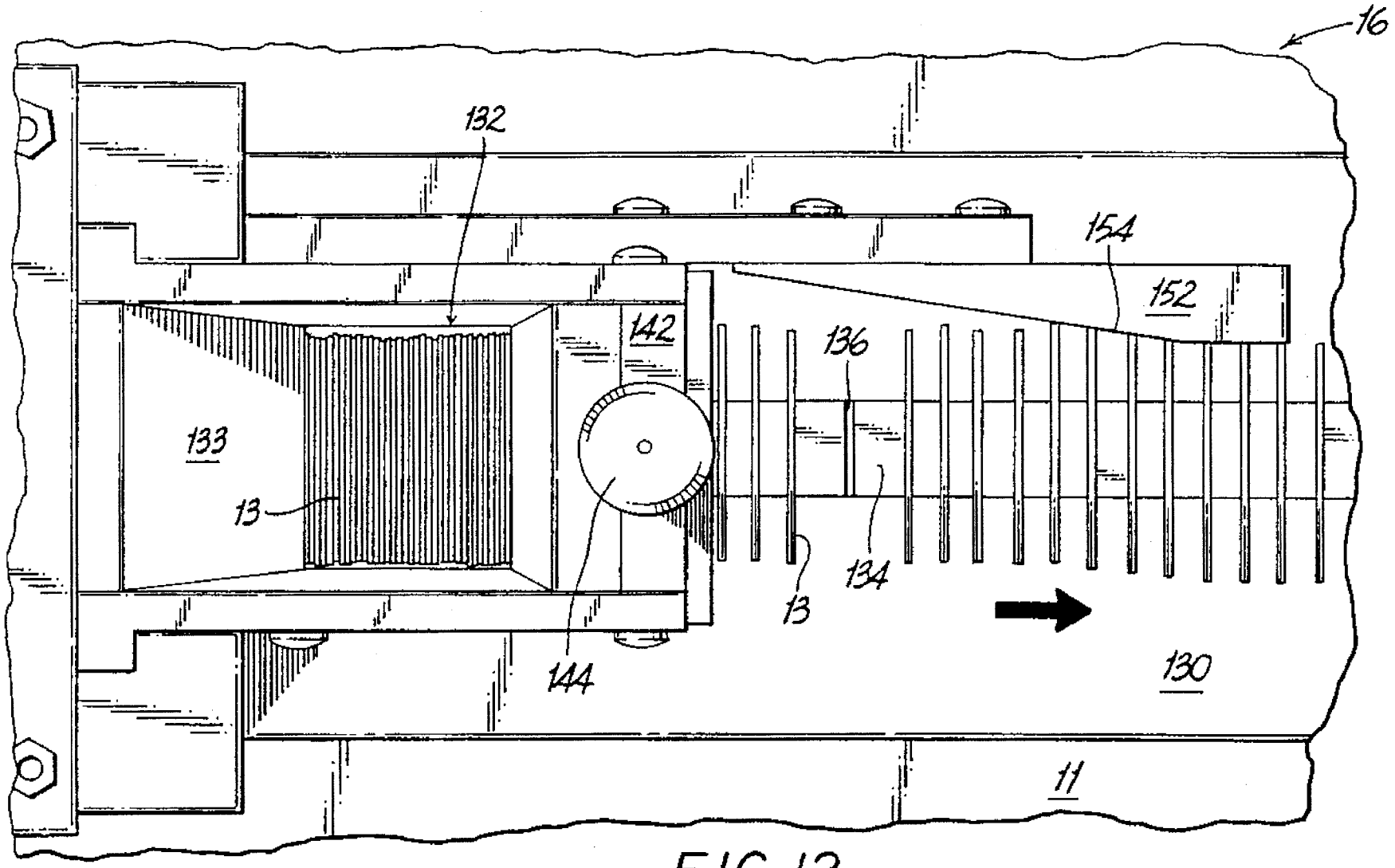
FIG. 12 is an enlarged plan view illustrating the loading apparatus shown in FIG. 10.

Referring to FIGS. 12–15, in operation, the loading apparatus 16 and the holding apparatus 12 of the needle transporting apparatus 10 are shown. Referring to FIG. 12, the loading apparatus 16 is shown positioning needles 13 from the needle receptacle 132 into the grooves 136 in the track 134 as the track is moved toward the loading station 155 by the rotation of knob 150.

Referring to FIG. 13, the needles 13 are in position at the loading station 155. The needle holding apparatus 12 is also in position on the mounting structure 56. The lever 34, and thereby the camming portion 36, are in position to open jaw structure 18 against the biasing nature of the spring 30. The jaws structure is opened by separating the upper and lower sections 20 and 22 of the holding apparatus 12.

More specifically, the jaw structure 18 is opened by lifting the actuation lever 34 upwardly as shown in FIG. 13, rotating the lever 34 about pivot rod 46. The camming portion 36 of actuation lever 34 abuts the camming surface 38 of the lower portion 22 of the holding apparatus 12, separating the upper and lower portions 20, 22 in relation to each other. This separation opens the upper and lower jaw sections 24, 26 against the biasing tension of the spring 30.

Referring to FIG. 14, the needle contacting portion 158 of the retaining structure 156 has been positioned on the needles 13 by moving actuating lever 160. The needles 13 are thereby retained in their desired position in the grooves 136 of the track 134. The holding apparatus 12 is then ready to be moved to position the needles 13 between the jaw structure 18.

The needle holding apparatus 12 moves toward the needles 13 in the loading station 155 by sliding the holding apparatus 12 mounted on the slidable mounting structure 56. The needles 13 are thus positioned between the open jaw structure 18. When the needles 13 are positioned between the jaw structure 18 the cylinder projection 57 is positioned in the hole 59 ensuring proper alignment of the jaw structure 18 with the needles 13.

Figure 15:
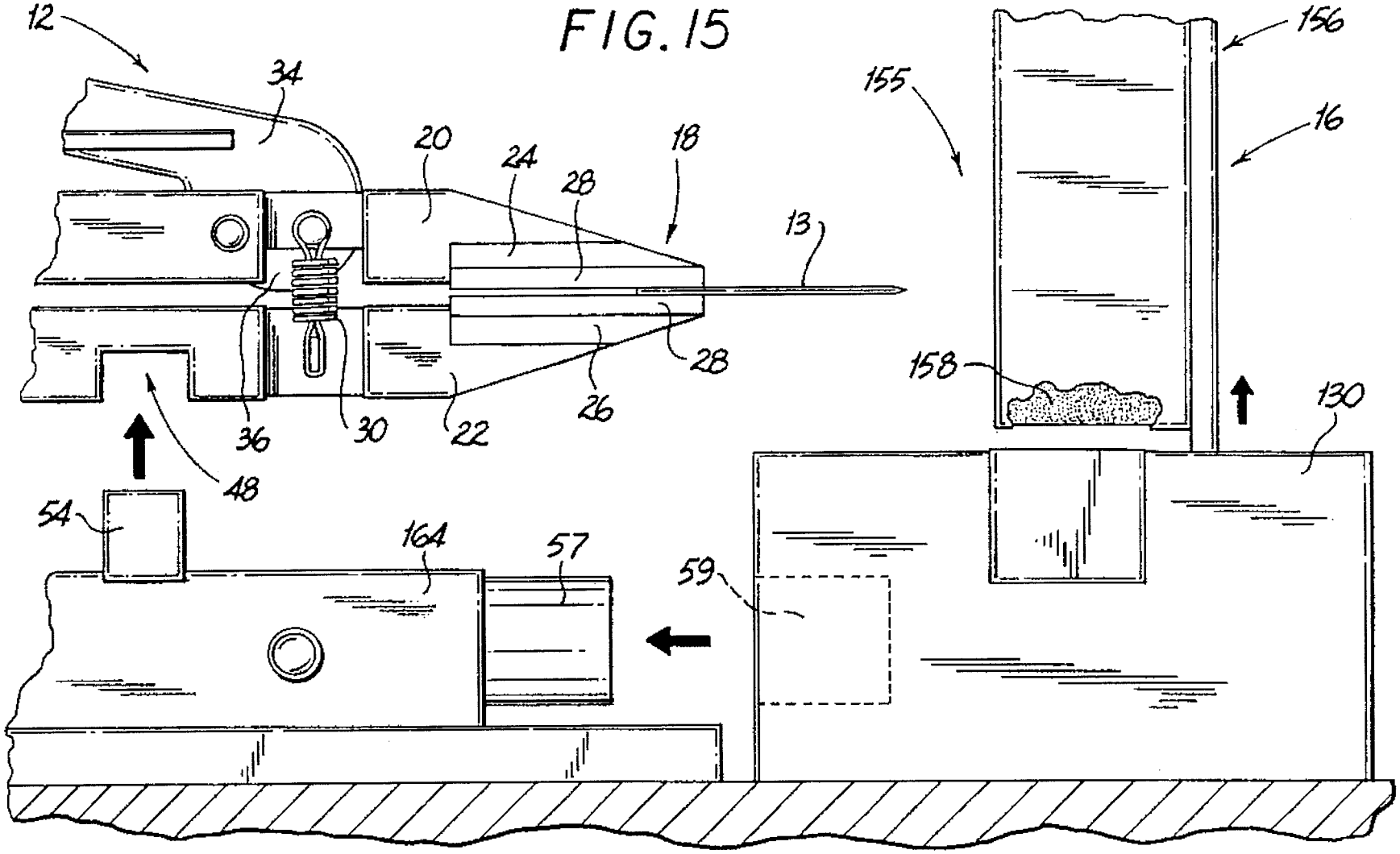

Referring to FIG. 15, the jaw structure 18 is closed on the needles 13 by lowering lever 34. The camming portion 36 thereby ceases to contact the camming surface 38 and the jaws are closed by the tensioning of the springs 30. The needles 13 are thereby held in the holding apparatus 12 and ready for removal from the loading apparatus 16.

The needles 13 are then released from the retaining structure 156 by actuating lever 160 (see FIGS. 10 and 11) to release the needle contacting portion 158 from the needles 13 in the grooves 136 on the track 134. The needle holding apparatus 12 may then be removed from the mounting structure 56, and the needles 13 held in the holding apparatus 13 are ready for transporting, for example, to a work or processing station.

Figure 16:
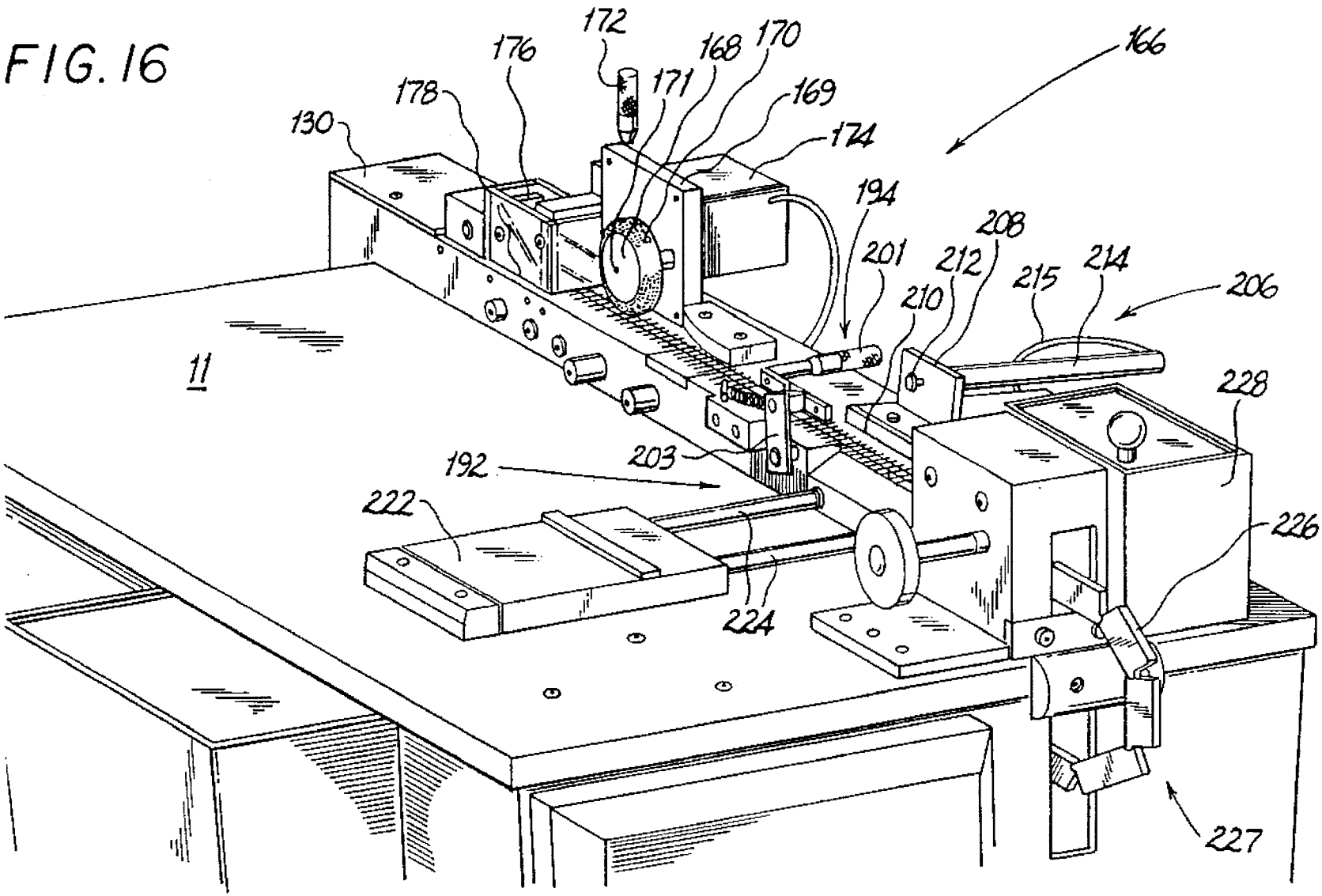
FIG. 16 is a perspective view illustrating another embodiment of a loading apparatus according to the invention which is substantially automated.

Another embodiment of a needle loading apparatus 166 for use with a needle transporting apparatus is shown in FIGS. 16–22. Referring to FIG. 16, a needle loading apparatus is shown which is similar to the previous embodiment of a needle loading apparatus 16 shown in FIGS. 1, and 10–15. However, the embodiment of the needle loading apparatus 166 shown in FIG. 16 is substantially automated and includes a rotatable positioning wheel 168 mounted to a wall 169 at axis 171. The wheel 168 includes a needle contacting portion 170 consisting of a suitable material, such as, the elastomeric materials previously mentioned. The proximity of the wheel 168 to the needles 13 positioned on the track 134 is adjusted by rotatable knob 172. The wheel 168 is preferably rotated in a counterclockwise direction at a predetermined speed by a motor 174 connected to the wall 169. The wheel 168 speed is preferably between about 2 and about 20 rpm's.

Figure 17:
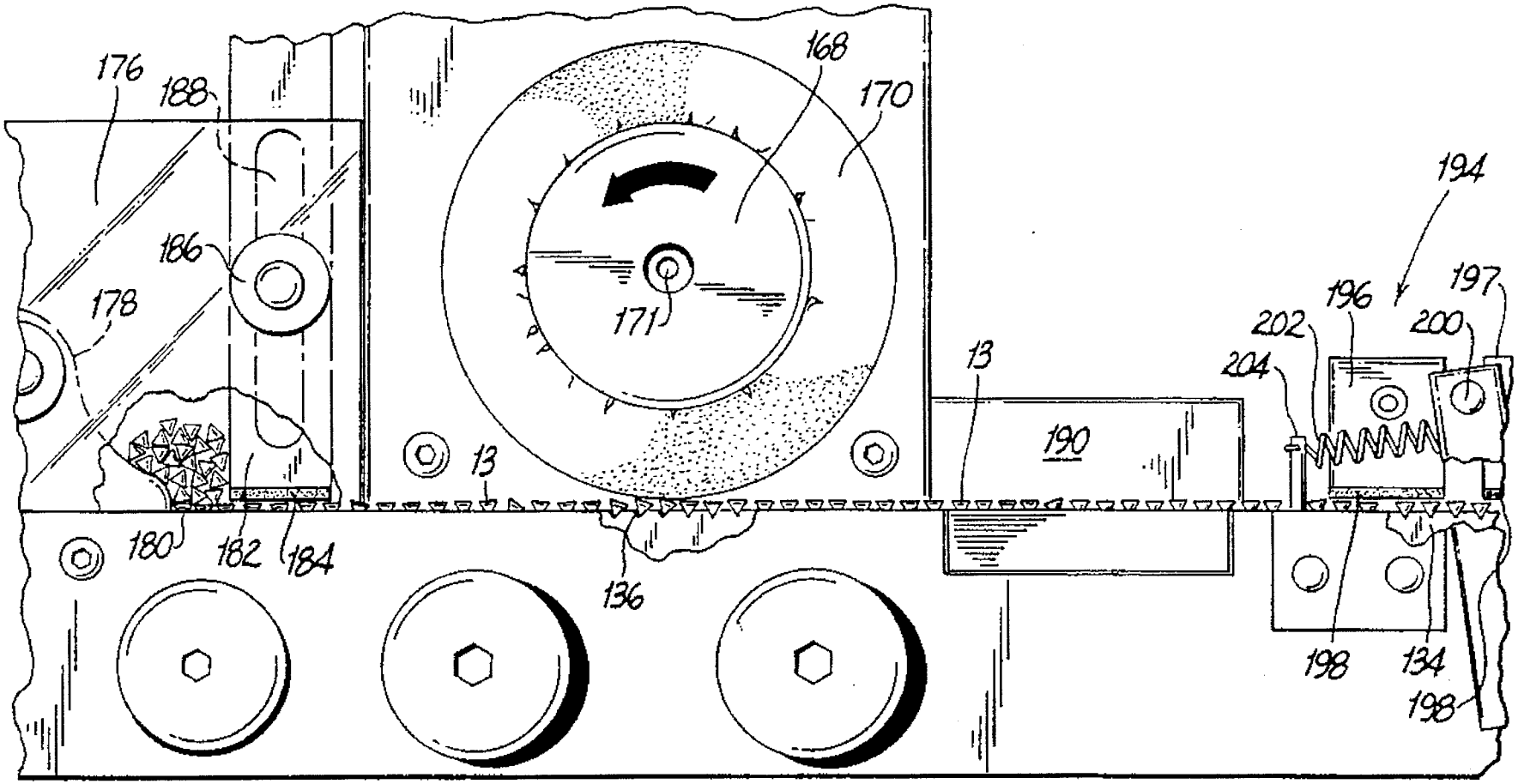
FIG. 17 is an enlarged side elevational view illustrating the loading apparatus shown in FIG. 16.

Needle receptacle 176 is essentially identical to the needle receptacle 132 shown in FIG. 10, however, the needle receptacle 176 shown in FIGS. 16 and 17 includes a curved wall 178 for encouraging needles toward opening 180. Referring to FIG. 17, a first positioning member 182 includes a needle contacting portion 184. The first positioning member 182 defines part of the opening 180 and is positioned in relation to track 134 such that the needles 13 are located in grooves 136 in the track 134 in a similar manner as with the positioning member 138 shown in FIG. 10. The proximity of the positioning member 182 contacting portion 184 to the needles 13 is adjusted by knob 186. Knob 186 secures a shaft within a selectable position in slot 188.

An aligning wall 190 is curved for aligning the needles on the track 134 as the needles 13 are moved towards the loading station 192. The curved aligning wall 190 substantially insures that the needles 13 are aligned evenly with respect to each other on the track 134, as with the aligning block 152 shown in FIG. 10.

A second positioning member 194 includes a first element 196 having a needle contacting portion 198 and a second element 197 also having a needle contacting portion 198. The needle contacting portion 198 is preferably of similar material as the contacting portion 184 of the first positioning member 182.

The first and second elements 196, 197 are biased in an initial position by spring 202. The spring is connected to pin 200 of pivotably mounted element 203 and post 204. The first and second elements 196, 197 are resiliently deflectable such that needles 13 are contacted and moved into the grooves 136 in the track 134. The height of the contacting portions 198 is adjusted by knob 201.

Figure 18:
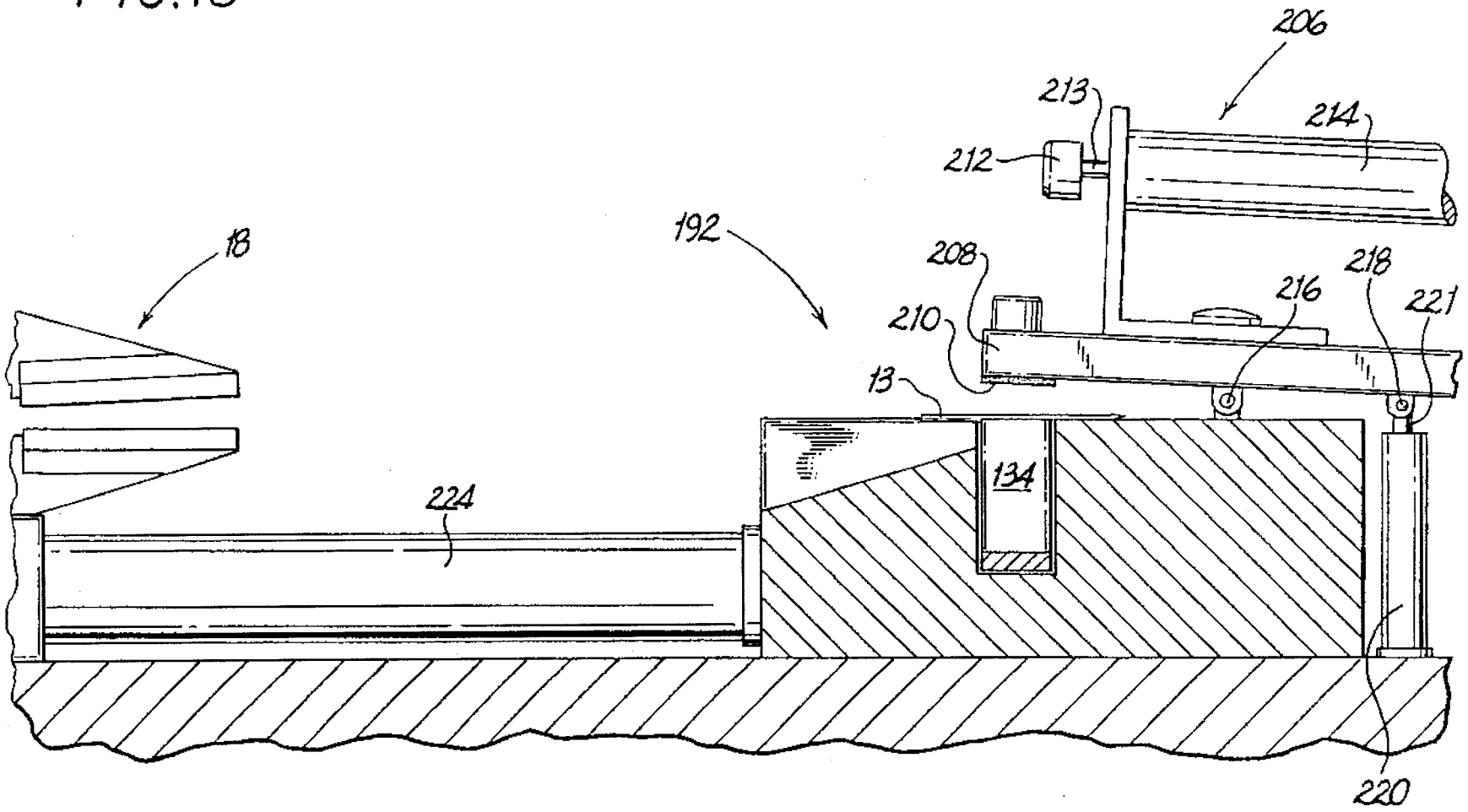
FIGS. 18–21 are side elevational views illustrating the needle transporting apparatus during a sequence of operation.

Referring to FIG. 18, a retaining mechanism 206 includes a body portion 208 having a needle contacting portion 210 and accommodating an actuation pin 212. The pin 212 is part of a pneumatic cylinder 214 having a shaft 213. The pneumatic cylinder 214 is preferably controlled by pneumatic interface 215 for selectively extending the shaft 213 and the pin 212 to move the lever 34 on the holding apparatus 12, shown in FIG. 20.

More specifically, as shown in FIG. 18, the body portion 208 is pivotably connected at pivot point 216 to the frame 130 of the loading apparatus 166. The body portion is further pivotably connected at pivot point 218 to pneumatic cylinder 220. Cylinder 220 selectively pivots the body portion 208 about pivot point 216 to lower the contacting portion 210 onto needles 13.

The loading apparatus further includes movable mounting surface 222 which functions essentially the same as mounting surface 56 shown in FIG. 10. However, the mounting surface 222 shown in FIG. 16 is slidably positioned on guide rods 224. The mounting surface 222 can be pneumatically actuated to move towards and away from the loading station 192.

The needle track 134 is subdivided into links 226 connected in a continuous loop 227 of links 226. The track links 226 are rotated about the work surface 11 by motor 228 at a predetermined speed.

In operation, referring to FIG. 18–21, the retaining mechanism 206 is in an open position having the needle contacting portion 210 of the body portion 208 out of contact with the needles 13, and the pneumatic cylinder 220 in a first position. Further, the needle holding apparatus 12 is oriented with the jaw structure 18 in an open position. The holding apparatus is positioned on the movable mounting surface 222 in a first position which is removed from the work station 192.

Figure 19:
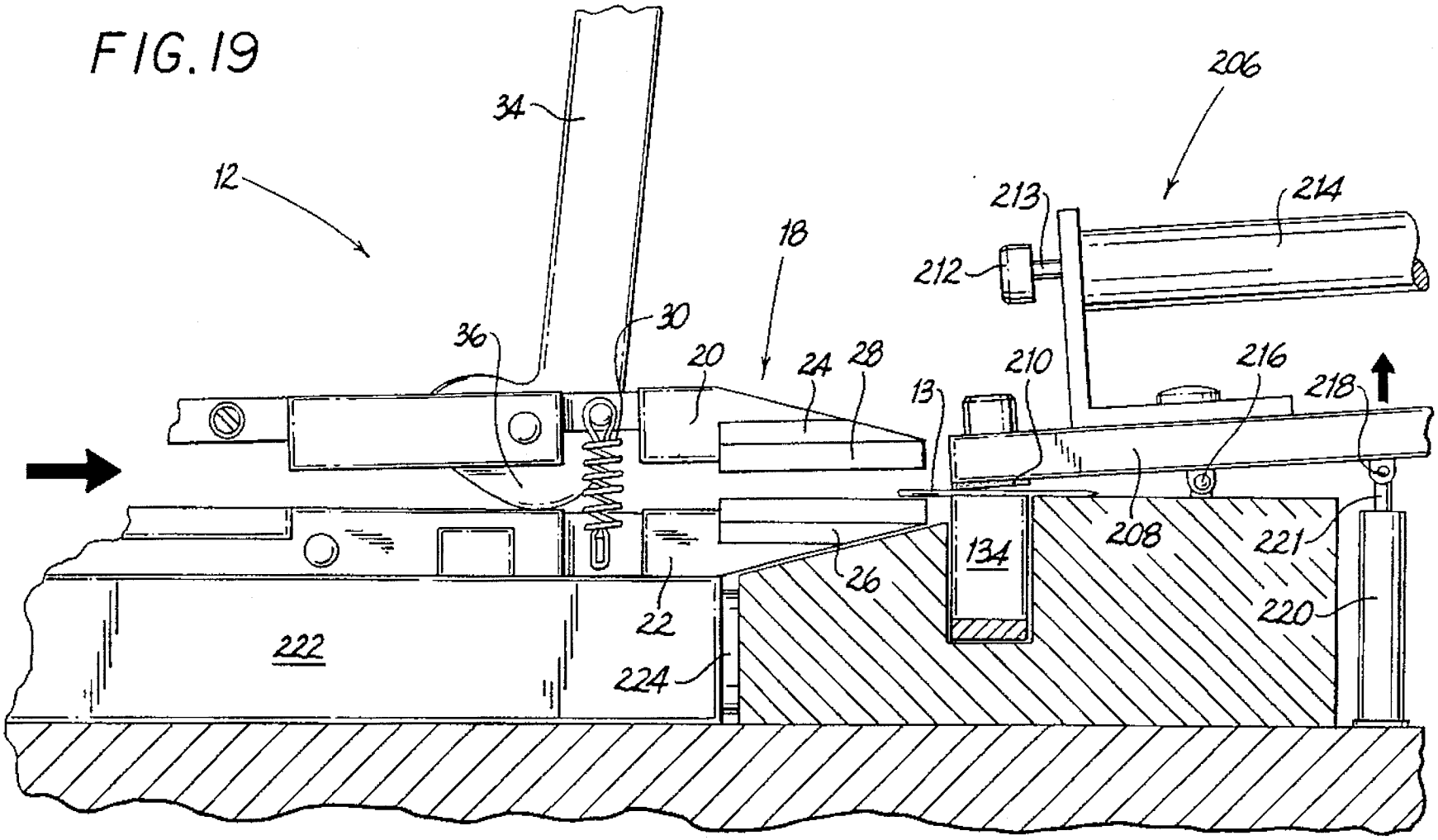

Referring to FIG. 19, the needle contacting portion 210 of the body portion 208 is positioned in engagement with the needles 13. The body portion 208 is activated by a shaft 221 of the pneumatic cylinder 220 moving to a second position pivoting the body portion about pivot point 216 to position the contacting portion 210 on the needles 13.

The needle holding apparatus 12 is identical to the holding apparatus 12 shown in FIGS. 1–9, and 13–15.

The jaw structure 18 of the holding apparatus 12 is in an open position. The holding apparatus 12 has been moved towards the needles held in the loading station 192, until the needles 13 are disposed between the open jaw structure 18. The holding apparatus has been moved forward via mounting surface 222 advancing on the rods 224.

Figure 20:
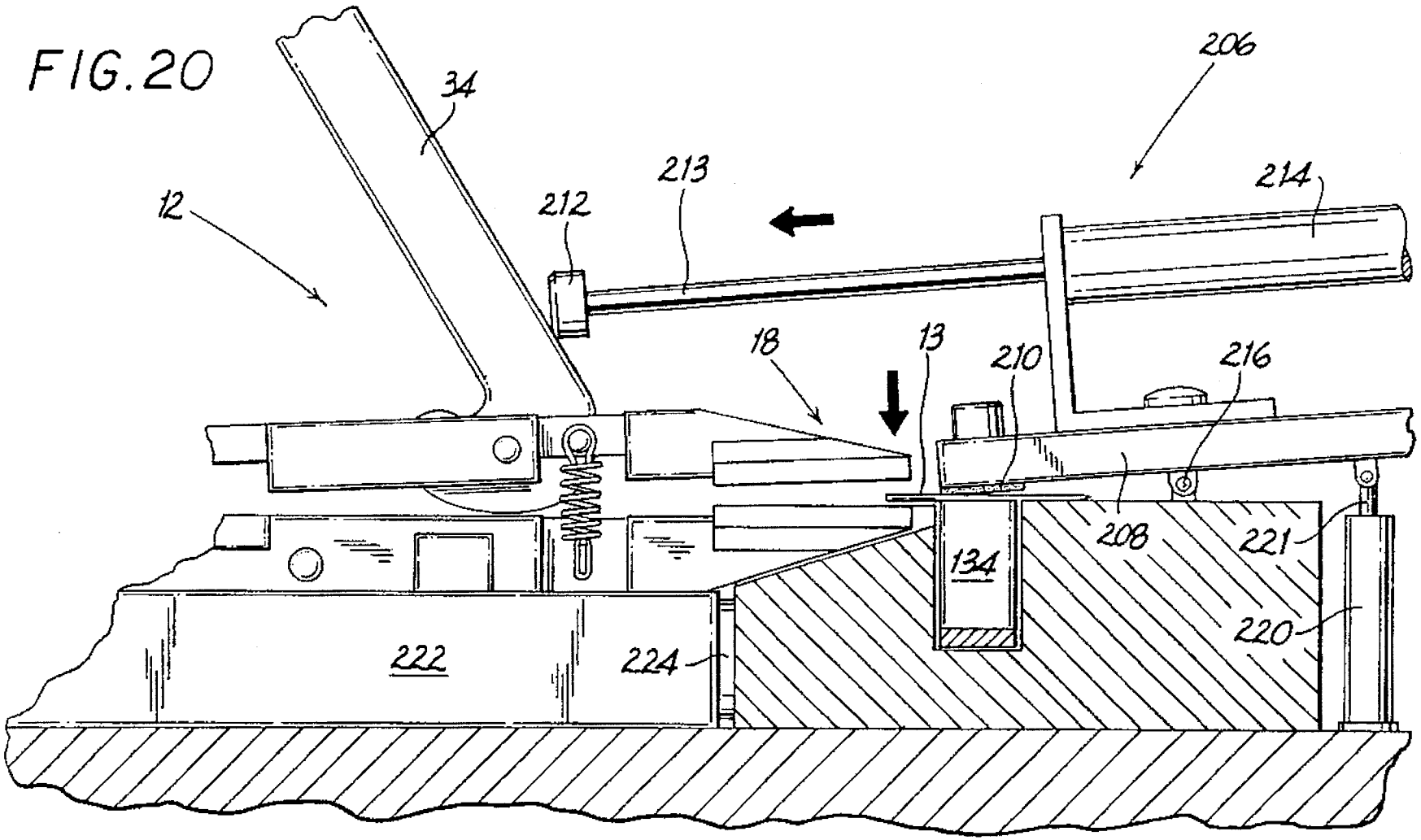
Figure 21:
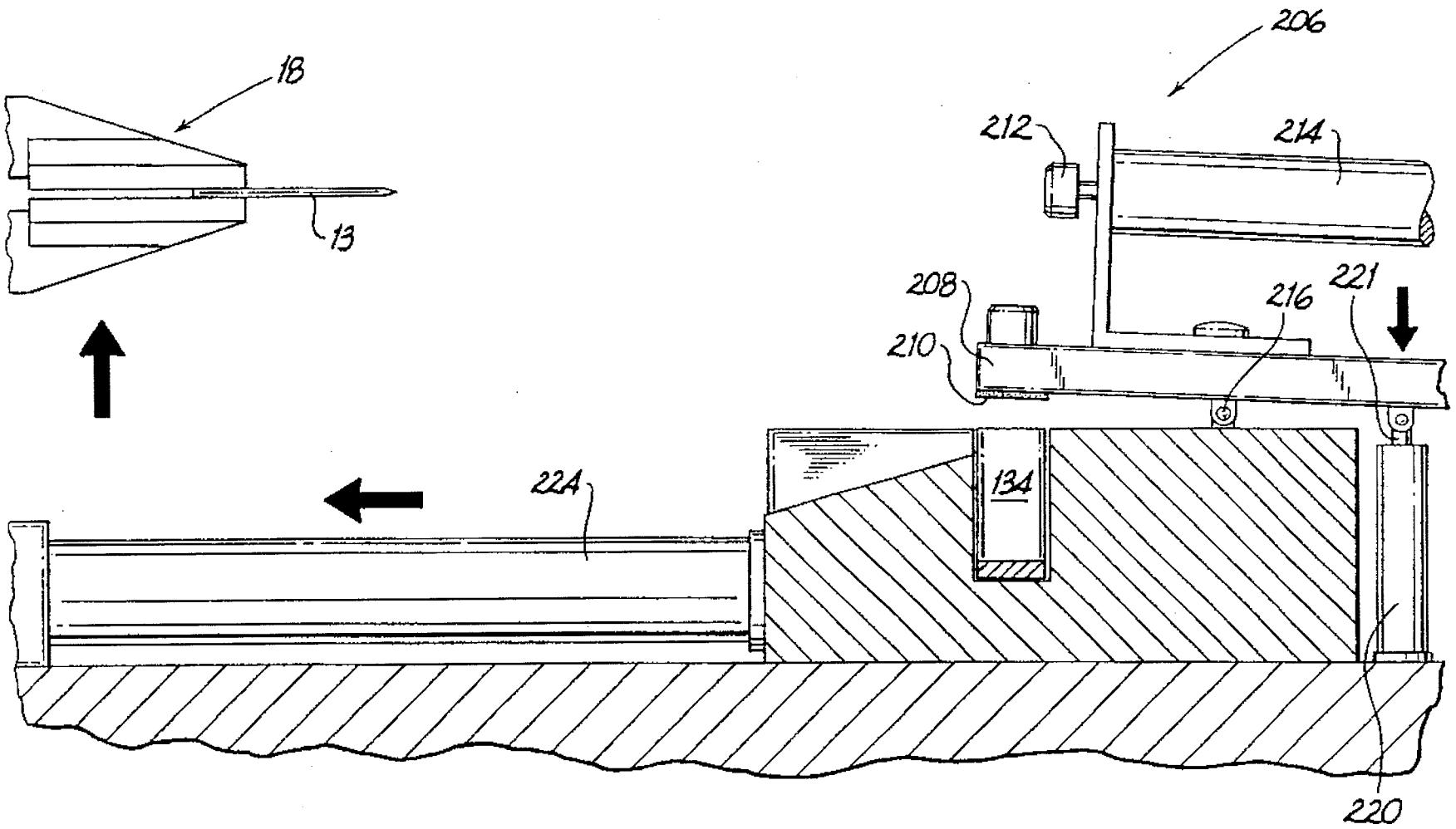

Referring to FIG. 20, the shaft 213 is fully extended and pin 212 is moved into contact with lever 34. The contact between the pin 212 and lever 34 pushes the lever 34 downwardly closing the jaw structure 18 on the needles 13. As shown in FIG. 21, the needle contacting portion 210 of the retaining mechanism 206 is returned to it initial position by moving shaft 221 of the pneumatic cylinder 220 to its first position. The body portion 208 is thus pivoted about pivot point 216 to release contact between the contacting portion 210 and the needles 13.

The needle holding apparatus 12 can then be returned to its initial position on the mounting surface 222 via rods 224. The needle holding apparatus 12 may then be lifted off the mounting surface 222 having the needles 13 positioned in its jaw structure 18 and transported, for example, to a work or processing station.

Figure 22:
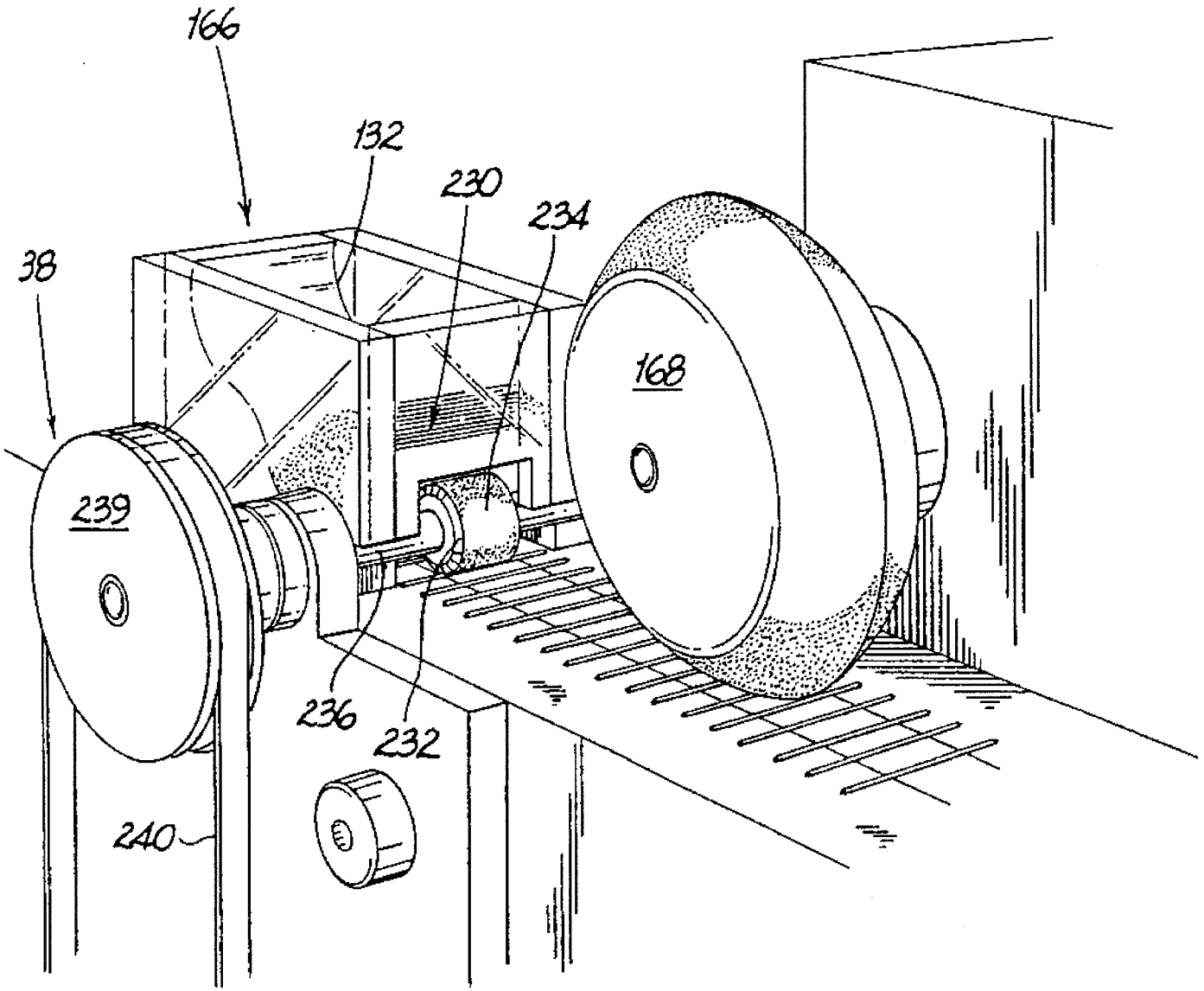
FIG. 22 is a perspective view of another embodiment of a loading apparatus according to the invention having another embodiment of an aligning structure.

Referring to FIG. 22, another embodiment of a positioning means is shown as positioning mechanism 230. The positioning mechanism 230 is incorporated in the loading apparatus 166 shown in FIGS. 16–21. The positioning mechanism 230 includes a rotating cylindrical wheel 232 having a needle contacting surface 234 being of a suitable material, such as, the elastomeric material previously mentioned.

The wheel 232 is rotated by shaft 236 which is connected to pulley system 238 including pulley 239. The belt 240 of the pulley system 238 is driven by a motor (not shown) for rotating the shaft 236 and wheel 232 at a predetermined speed. The wheel 232 is rotated in a clock-wise direction to encourage needles not properly positioned for mating with the grooves 136 of the track 134 to reenter the needle receptacle 132. The rotating speed of the wheel 232 is preferably between about 20 and about 100.

Another embodiment of a needle holding apparatus of a needle transporting apparatus is shown in FIGS. 23–31. The holding apparatus 244, in some respects, is similar to the holding apparatus 12 shown in FIGS. 1–7.

Figure 23:
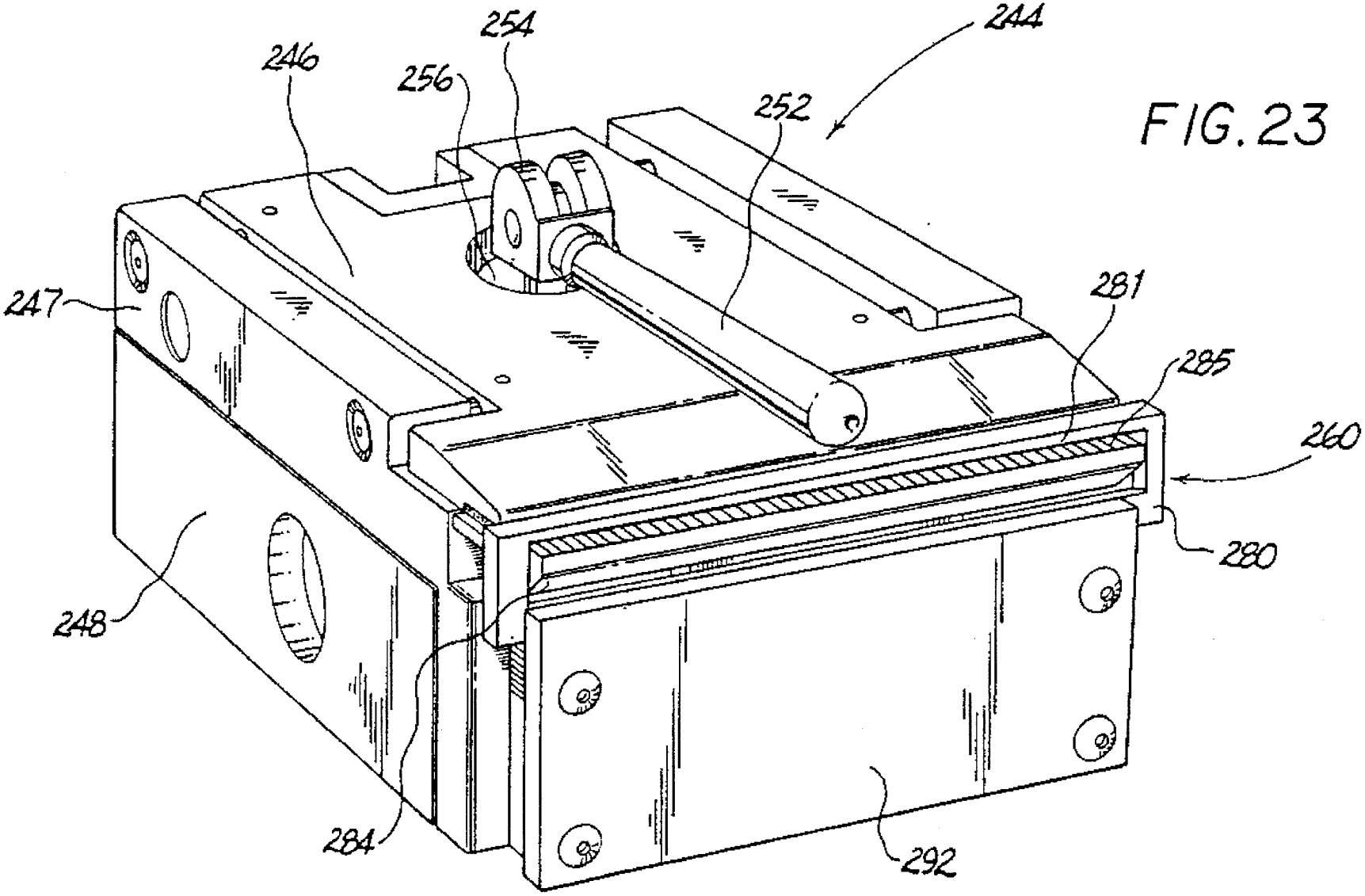
FIG. 23 is a perspective view illustrating another embodiment of a holding apparatus according to the present invention.
Figure 24:
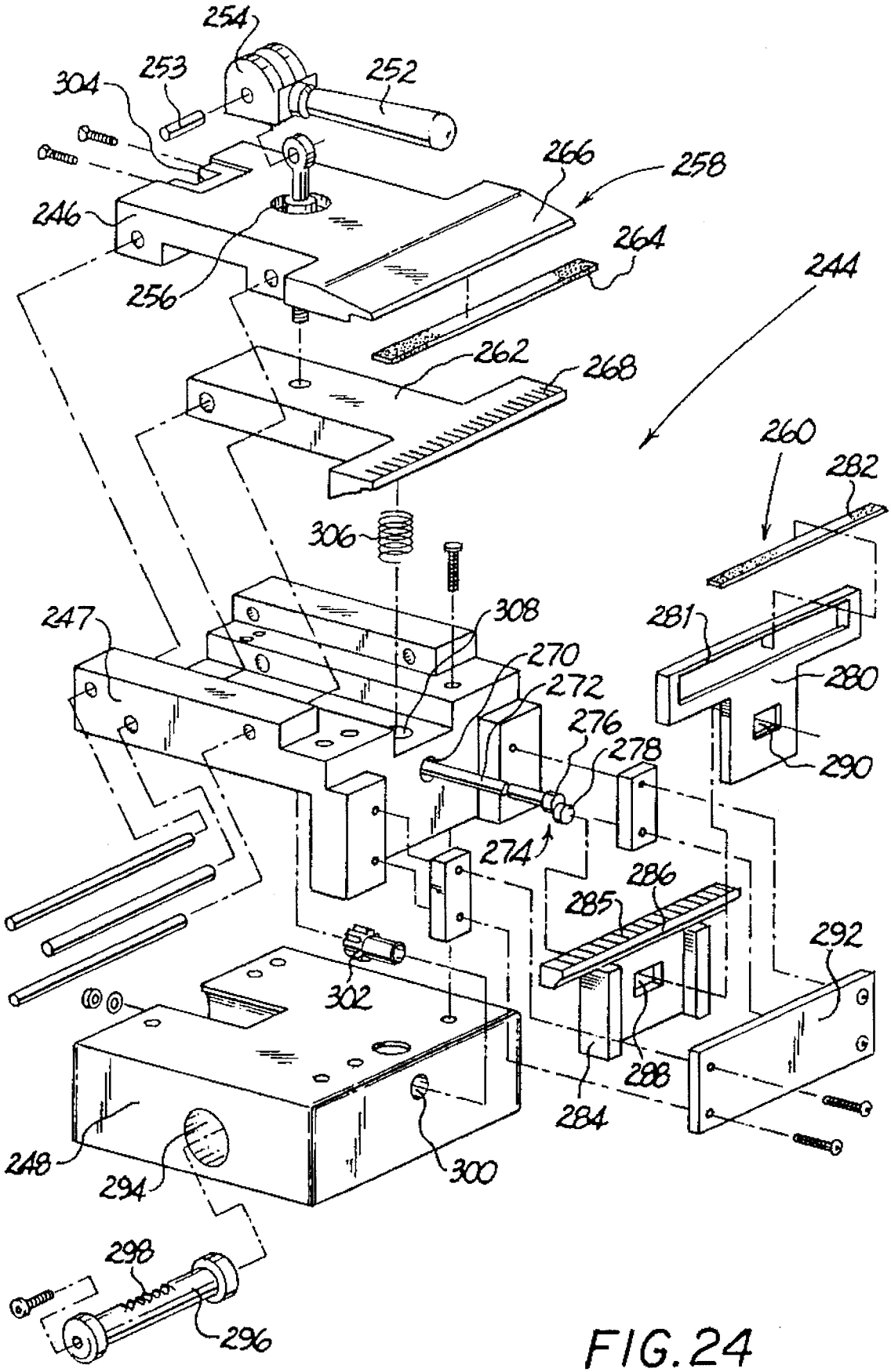
FIG. 24 is an exploded view illustrating the holding apparatus of FIG. 23.

Referring to FIGS. 23 and 24, the holding apparatus 244 includes an upper portion 246, middle portion 247, and a lower portion 248 in overlapping relation. The upper portion 246 includes a lever 252 having a camming surface 254. The camming surface 254 selectively communicates with a sleeve portion 256 for actuating the lower section 262 of the first jaw structure 258.

The first jaw structure 258 is positioned on the distal end of the holding apparatus 244 and between the upper and middle portions 246, 247. A needle contacting material 264 is positioned on the upper section 266 of the first jaw structure 258 for working in concert with needle grooves 268 of the lower section 262.

The second jaw structure 260 is connected to the middle portion 247 of the holding apparatus 244. The second jaw structure 260 includes a frame 280 defining an upper jaw section 281 having needle contacting material 282. The second jaw structure further includes lower jaw section 284 having grooves 285 in a needle contacting portion 286.

As shown in FIG. 24, the middle portion 247 is dimensioned and configured to accommodate the upper portion 246. The middle portion 247 includes an aperture 270 for accepting a camming shaft 272. The camming shaft 272 includes a camming end 274 having first and second cams 276, 278.

The frame 280 and the lower jaw section 284 are mounted on the middle portion 247 such that the camming end 274 of the camming shaft 272 is positioned in a hole 288 in the lower section 284 and a corresponding hole 290 in the frame 280. The second jaw structure 260 is positioned between the middle portion 247 and a lock plate 292 thereby securing the second jaw section 260 in place.

As shown in FIG. 24, the middle and upper portions 247 and 246 are positioned on the lower portion 248. The lower portion includes a hole 294 for accommodating a gear shaft 296 having gear teeth 298. The lower portion 248 further includes a hole 300 for rotatably accommodating a gear 302. The gear 302 is connected to the opposite end of the camming shaft 272 with respect to the camming end 274. The gear teeth 298 of the gear shaft 296 and the gear 302 are in mating relation for laterally moving frame 280 downwardly, and the lower section 284 upwardly. The interaction of the upper section 281 of the frame 280 and the contacting portion 286 of the lower section 284 provides selectable opening and closing of the second jaw structure 260.

Spring 306 is mounted in hole 308 in the middle portion 247. The spring 306 contacts the lower section 262 of the first jaw structure 258 thereby biasing the lower jaw section 262 in a closed relation with the upper jaw section 266. Camming surface 254 of lever 252 is rotatable about pivot pin 253 and opens the first jaw structure 258 against the biasing of the spring 306 when the camming surface 254 in positioned against the sleeve portion 256.

Figure 25:
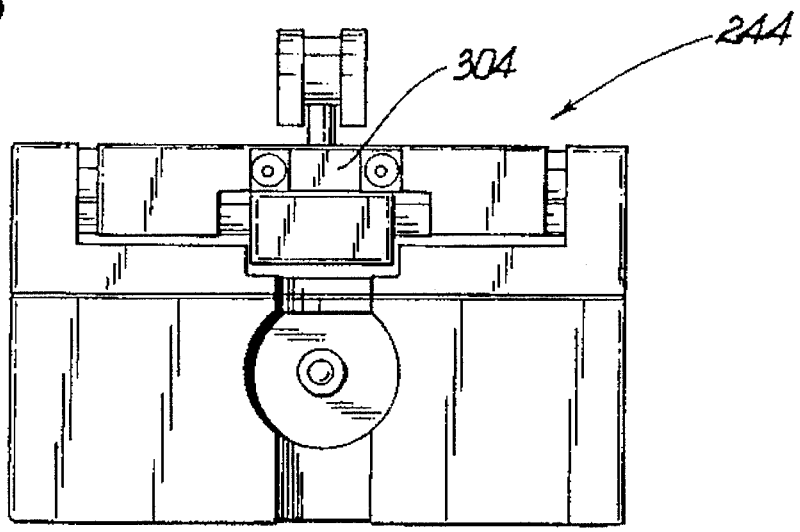
FIG. 25 is a rear elevational view illustrating the holding apparatus of FIG. 23.
Figure 26:
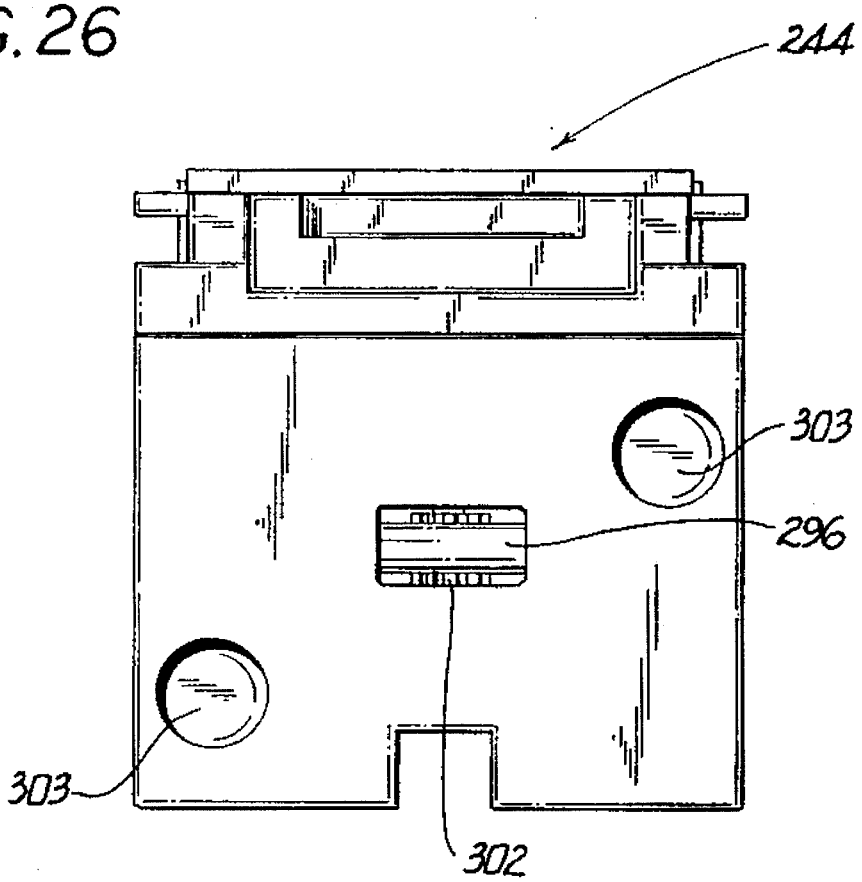
FIG. 26 is a bottom view illustrating the holding apparatus of FIG. 23.

Referring to FIGS. 25 and 26, upper portion 246 includes a rectangular notch 304. The notch mates with an approximating member to shift the upper portion 246 laterally with respect to middle portion 247 and lower portion 248. This lateral shifting rolls the needles 13 a predetermined amount while being held in the grooves 268 of the first jaw structure 258.

Two mounting indentations 303 are positioned on the bottom of the holding apparatus 244, as shown in FIG. 26. The indentations 303 provide positive positioning of the holding apparatus 244 on a mounting surface.

Figure 27:
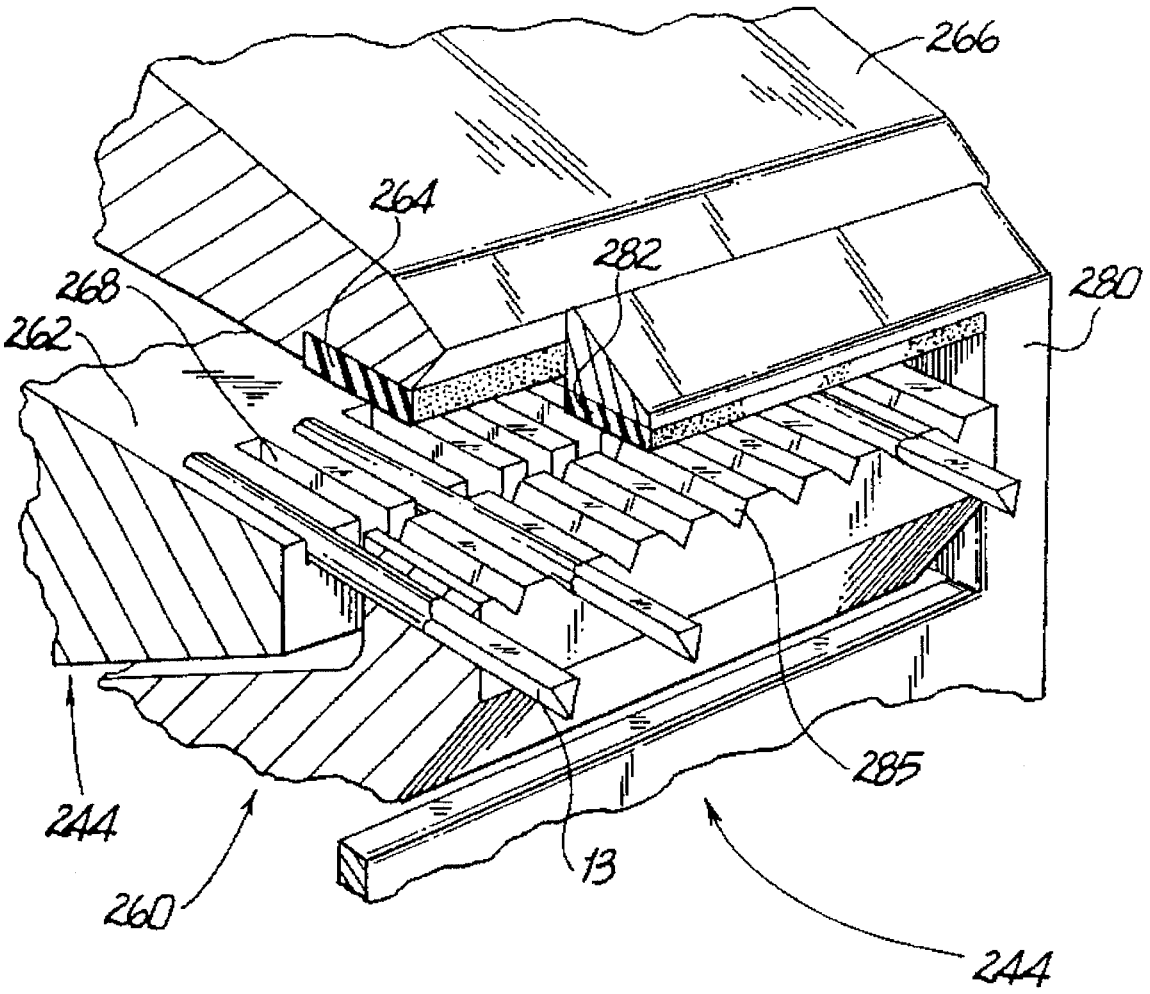
FIG. 27 is an enlarged perspective view illustrating the holding apparatus shown in FIG. 23.

Referring to FIG. 27, an enlarged view is shown of the first and second jaw structures 258, 260 and their corresponding grooves 268 and 285. The grooves 268, 285 are aligned to position needles 13 continuously between the first and second jaw structures 258, 260. The first jaw structure 258 includes generally rectangular shaped grooves 268 permitting uniform rotation of the needles 13 having a circular shank 15. The second jaw structure 260 includes generally "V" shaped grooves 285. The "V" shaped grooves 285 securely mate with triangularly shaped needles 13 to insure correct orientation of the needle 13.

Figure 28:
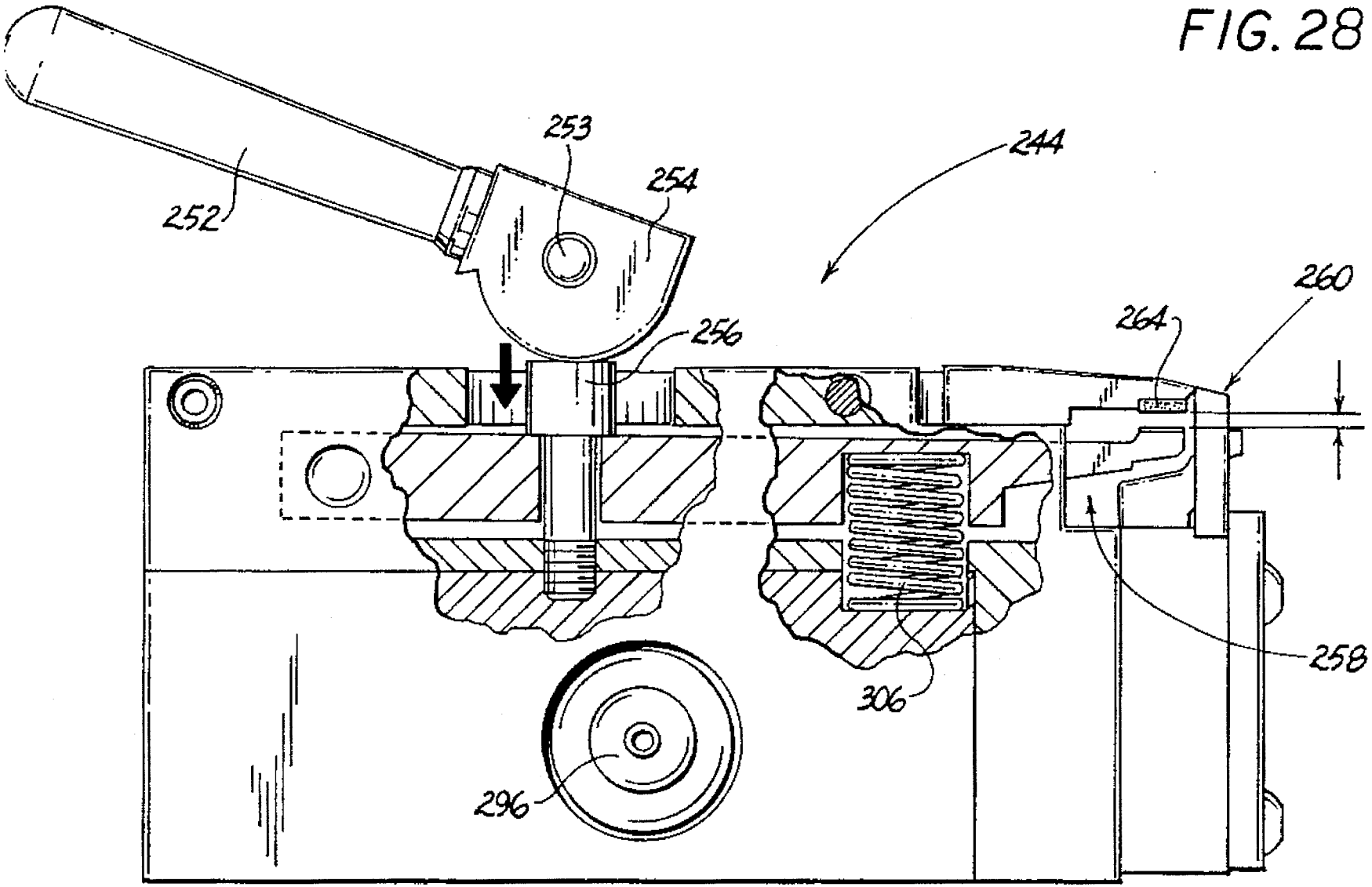
FIG. 28 is a side elevational view illustrating the holding apparatus shown in FIG. 23.
Figure 29:
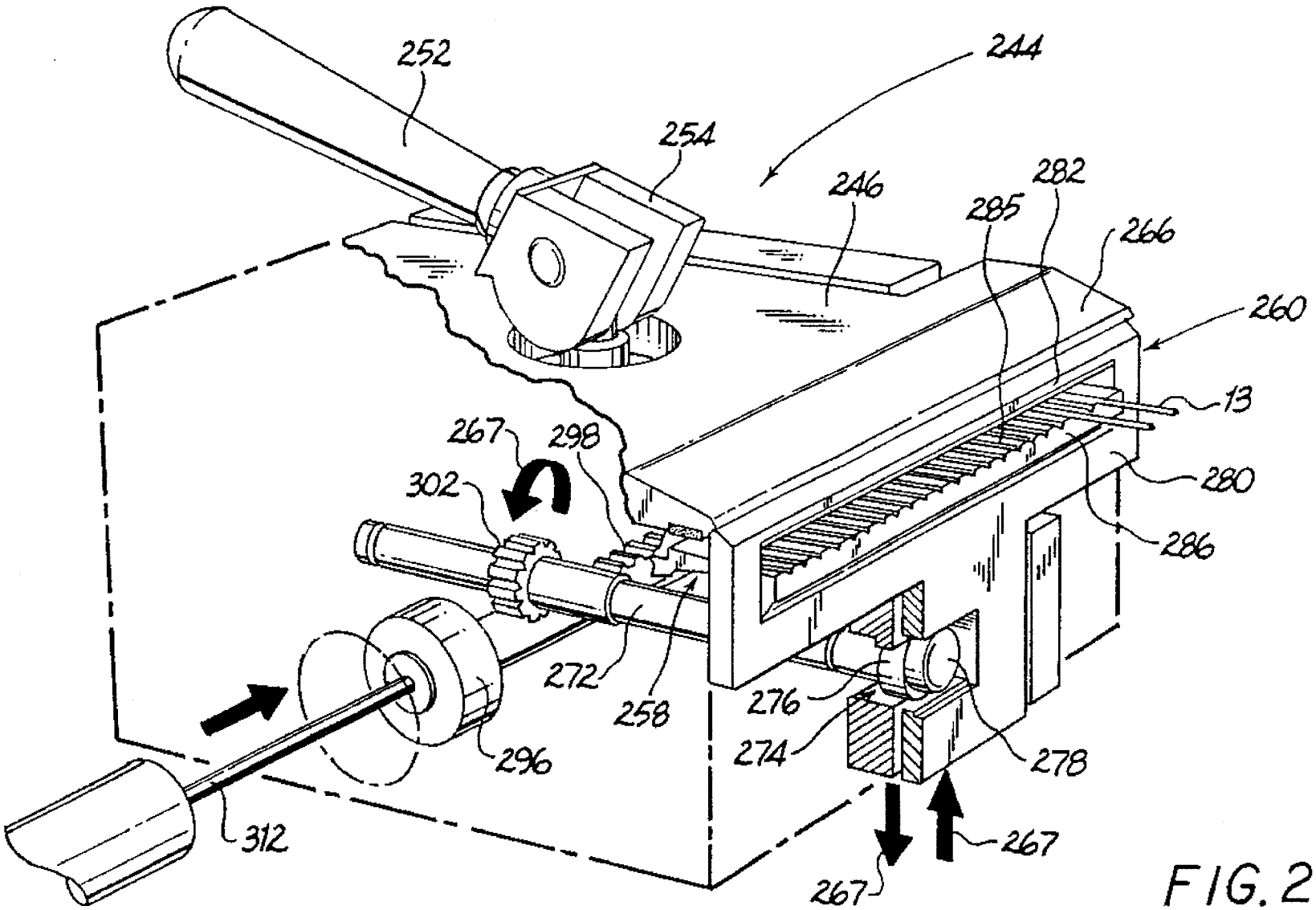
FIG. 29 is a perspective view having a partial cut-away illustrating the holding apparatus shown in FIG. 23.

Referring to FIGS. 28 and 29, the needle holding apparatus 244 is in an initial position having both first and second jaw structures 258 and 260 in an open position, as shown in FIG. 28. The camming surface 254 is positioned against the sleeve portion 256 to open the first jaw structure 258. Further, as best seen in FIG. 29, the camming end 274 of the camming shaft is positioned in the holes 288 and 290 such that the frame 280 and contacting portion 286 are distal from one another. Rotation of the camming shaft 272 manipulates the second jaw structure 260 as indicated by arrows 267.

Figure 30:
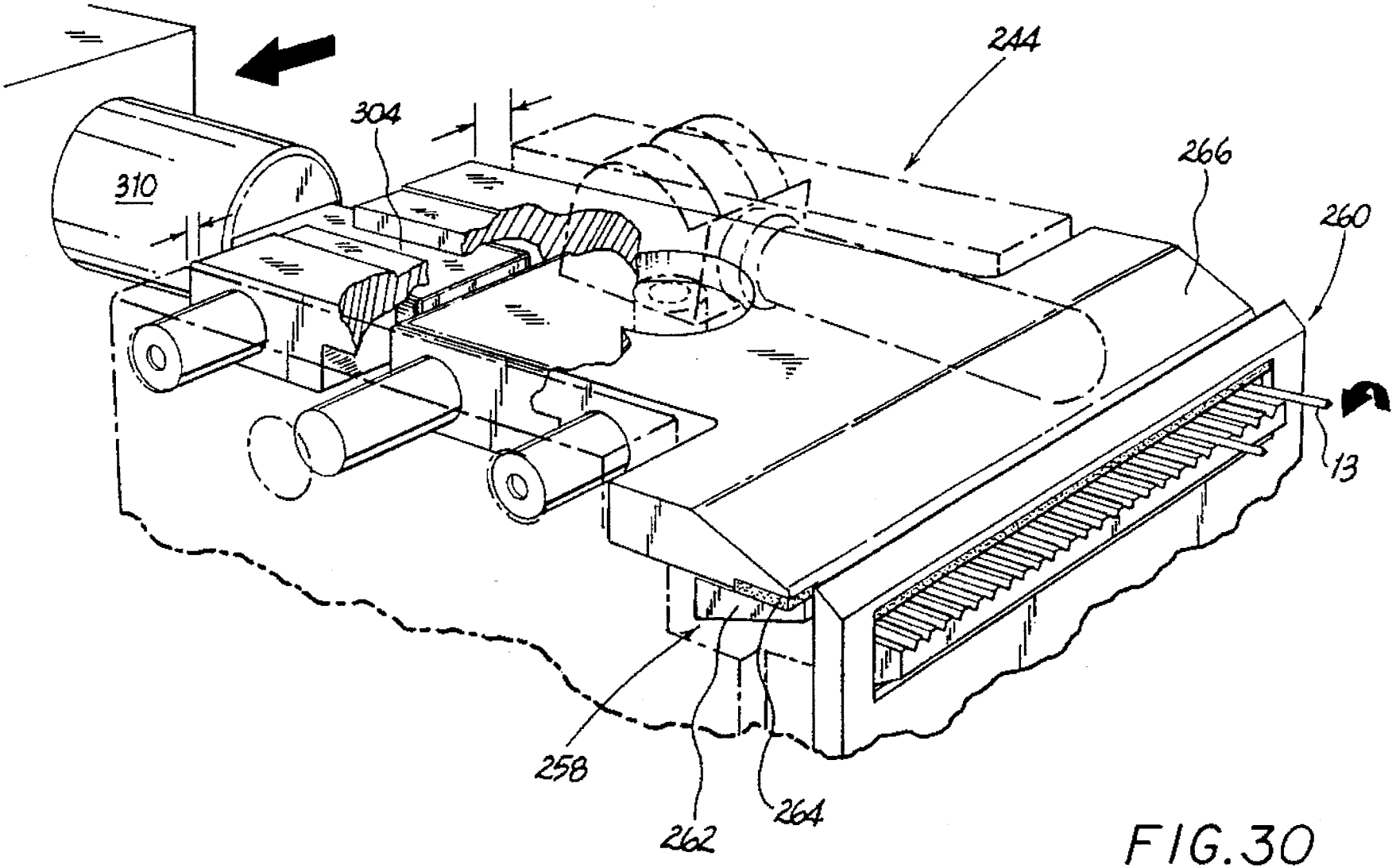
FIGS. 30 and 31 are perspective views having a partial cut-away illustrating the holding apparatus shown in FIG. 23 during a sequence of operation.
Figure 31:
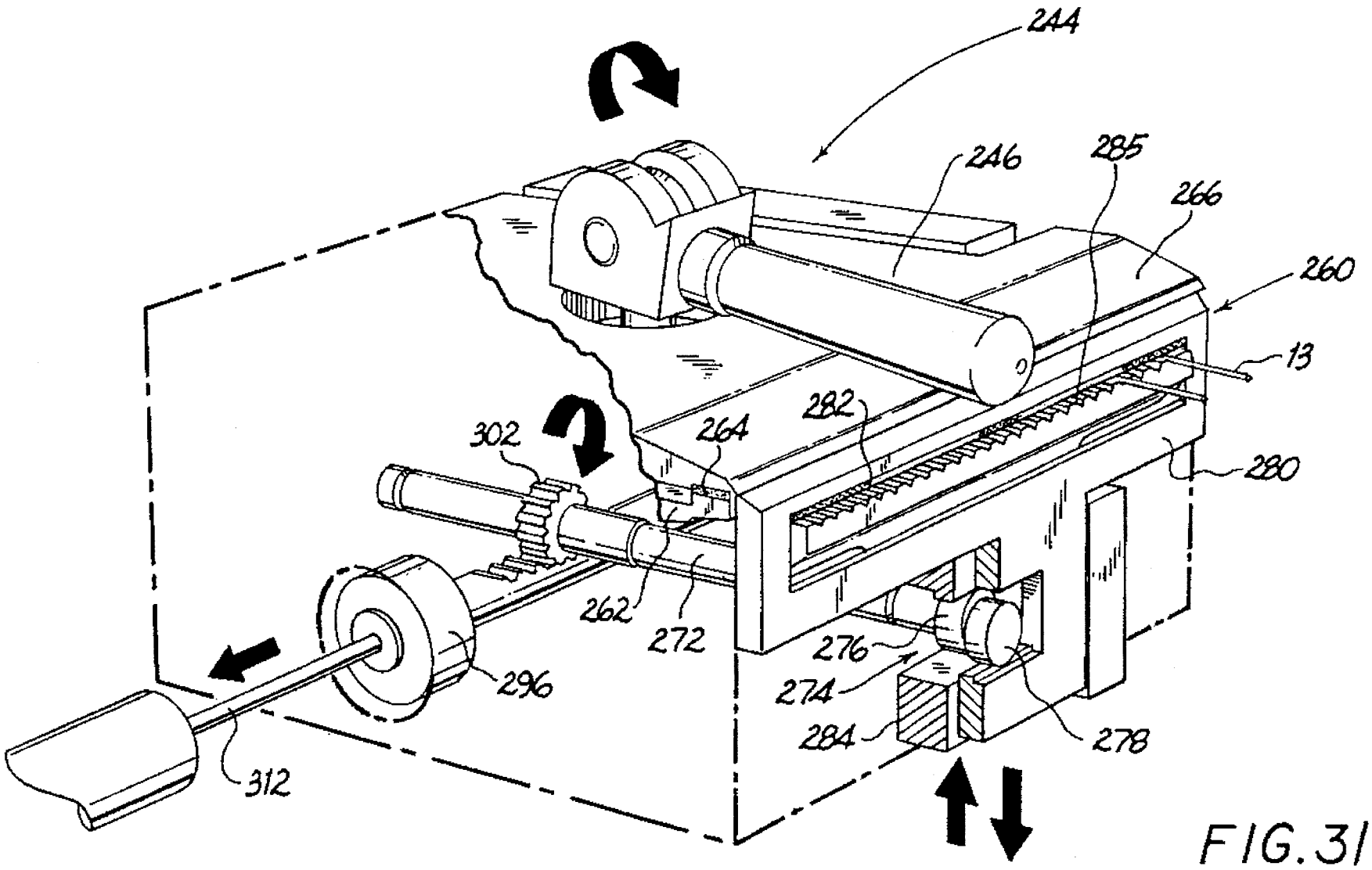

In operation, referring to FIGS. 30 and 31, the first jaw structure 258 is in a closed position since lower section 262 is in contact with upper jaw section 266 and holding a needle 13 therebetween. The second jaw structure 260 is in an open position.

The needles 13 held in the first jaw structure 258 are rotated by laterally moving the upper portion 246. A moving beam 310 is positioned in the rectangular notch 304 and is used as an approximating member. The moving beam 310 selectively moves the upper portion 246 laterally to rotate the needles 13 in the grooves 285, 268 a specified amount. The needle 13 rotation is caused by the frictional contact of the upper jaw section 266 contacting material 264 on the needles 13 held in the grooves 268.

After the needles 13 have been angularly rotated the desired amount, the second jaw structure 260 may be closed on the needles 13 further securing of the needles 13 in their specified position in the holding apparatus 244. The first and second camming sections 276, 278 interact with the respective lower jaw 284 and the frame 280 to move the frame down, and the lower jaw up. This action closes the second jaw structure 260 when the needles 13 are held securely between the upper jaw section 266 contacting material 282 and the grooves 285 in the contacting portion 286.

The camming end 274 is activated by moving gear shaft 296 laterally to engage gear 302, thereby, rotating camming shaft 272. The gear shaft 296 is moved by actuation rods 312 positioned on both sides of the holding apparatus (only one is shown in FIG. 31). The actuation rods 312 rotate camming shaft 272 in either direction by actuating the corresponding side of the gear shaft 296 to achieve the desired rotational movement of camming shaft 272.

Once both the first and second jaw structures 258, 260 are in a closed position, the needles 13 are thereby secured in the holding apparatus 244. The needles may be then be securely transported to a work or processing station using the holding apparatus 244.

While the present invention is described herein with respect to needles, it should be understood that the devices of this invention may be employed to hold and/or transport any elongated workpiece, including, but not limited to, needle blanks.

While the invention has been particularly shown, and described with reference to the preferred embodiments, it will be understood by those skilled in the art that various modifications and changes in form and detail may be made therein without departing from the scope and spirit of the invention. Accordingly, modifications such as those suggested above, but not limited thereto, are to be considered within the scope of the invention.

What is claimed is:

1. A system for processing a plurality of elongated workpieces each having a polygonal cross-sectional configuration, said system comprising:

a movable track having a plurality of spaced apart workpiece receiving grooves each having a cross-sectional configuration which complements the cross-sectional configuration of each of said workpieces, said grooves provided to receive said workpieces in a predetermined fashion;

a contacting element positioned above said movable track to contact and urge workpieces which remain unseated on said track into unoccupied grooves;

stationary aligning means having a fixed position with respect to said movable track for sequentially aligning the workpieces in a longitudinal side-by-side arrangement on the track such that a first end portion of each of the workpieces is presented in a desired orientation; and holding means separate from said aligning means and having first and second jaw members movable between a first open position and a second closed position for simultaneously receiving and subsequently grasping at least said first end portion of a plurality of said workpieces prior to removal of said plurality of workpieces from said track.

2. A system according to claim 1 further comprising retaining means having a workpiece contacting portion for releasably restraining said workpieces in a predetermined position.

3. A system according to claim 2 wherein said workpiece contacting portion of retaining means selectively contacts said workpieces.

4. A system according to claim 1 further comprising a means for orientating said workpieces in a predetermined manner on said movable track.

5. A system according to claim 1 further comprising a workpiece transporting apparatus which includes said holding means.

6. An apparatus for presenting elongated workpieces to a holder, each workpiece having a polygonal cross-sectional configuration, said apparatus comprising:

storage means which accommodates a multiplicity of workpieces, said storage means configured and dimensioned to permit sequential delivery of said workpieces therefrom;

transport means for sequentially receiving said workpieces from said storage means and moving same to a position accessible to a holding means, said transport means having a plurality of spaced apart workpiece receiving grooves provided therein each having a cross-sectional configuration which complements the cross-sectional configuration of each of said workpieces;

contacting means positioned above said transport means and mounted for movement with respect thereto for contacting and urging workpieces which remain unseated on said transport means into unoccupied grooves;

stationary alignment means having a fixed position with respect to said transport means for aligning said workpieces received by said transport means within said plurality of grooves; and holding means separate from said alignment means and having first and second jaw members movable between a first open position and a second closed position for simultaneously receiving and subsequently clamping at least a first end portion of a plurality of said workpieces prior to removal of the workpieces from said transport means.

7. An apparatus according to claim 6 further comprising workpiece retaining means for holding said one or more workpieces in a fixed position on said transport means.

8. An apparatus according to claim 7 wherein said retaining means is selectively engageable with said transport means.

9. Apparatus according to claim 6 wherein said transport means includes a track portion having grooves for removably receiving at least a portion of said workpiece.

10. Apparatus according to claim 9 wherein said grooves of said track are substantially triangular in cross section.

11. Apparatus according to claim 6 further comprising a slidable mounting surface being substantially orthogonal to said transport means, said mounting surface being adapted to accommodate said workpiece holding means.

12. An apparatus according to claim 6 wherein said alignment means comprises positioning means having a workpiece contacting portion, said positioning means urging said workpieces to a predetermined position on said track.

13. An apparatus according to claim 12 wherein said workpiece contacting portion comprises a non-abrasive material.

14. An apparatus for presenting surgical needle blanks to a holder, each needle blank having a polygonal cross-sectional configuration, said apparatus comprising:

dispensing means for sequentially delivering surgical needle blanks onto a transport means and for seating said surgical needle blanks in a predetermined manner on said transport means, said transport means having a plurality of spaced apart needle receiving grooves formed therein each having a cross-sectional configuration which complements the cross-sectional configuration of said needle blanks;

contacting means operatively associated with said dispensing means and positioned above said transporting means for urging workpieces which remain unseated on said transport means into unoccupied grooves; and stationary alignment means having an inclined guide surface for directing surgical needle blanks within said grooves into a longitudinal side-by-side arrangement such that a first end of each of the surgical needle blanks is aligned.

15. An apparatus as in claim 14 wherein the transport means comprises:

a track having grooves dimensioned and configured to receive the surgical needle blanks; and activation means for moving the track.

16. An apparatus as in claim 14 further comprising retaining means selectively engageable with the surgical needle blanks for releasably maintaining the surgical needle blanks in a predetermined position on the transport means.

* * * * *